US012757986B2

(12) United States Patent
Ma

(10) Patent No.: US 12,757,986 B2
(45) Date of Patent: Oct. 13, 2026

(54) CANTILEVER UMBRELLA WITH STABILIZING ASSEMBLY

(71) Applicant: Zhun-An Ma, Ningbo (CN)

(72) Inventor: Zhun-An Ma, Ningbo (CN)

( * ) Notice: Subject to any disclaimer, the term of this patent is extended or adjusted under 35 U.S.C. 154(b) by 270 days.

(21) Appl. No.: 18/625,575

(22) Filed: Apr. 3, 2024

(65) Prior Publication Data

US 2024/0335014 A1 Oct. 10, 2024

Related U.S. Application Data

(60) Provisional application No. 63/494,551, filed on Apr. 6, 2023.

(51) Int. Cl.
*A45B 25/22* (2006.01)
*A45B 23/00* (2006.01)

(52) U.S. Cl.
CPC ..... *A45B 25/22* (2013.01); *A45B 23/00* (2013.01); *A45B 2023/0012* (2013.01); *A45B 2023/0037* (2013.01); *A45B 2023/0081* (2013.01)

(58) Field of Classification Search
CPC . A45B 25/22; A45B 23/00; A45B 2023/0012; A45B 2023/0037; A45B 2023/0081
USPC ..... 135/20.1, 27, 98
See application file for complete search history.

(56) References Cited

U.S. PATENT DOCUMENTS 229,685 A 7/1880 Ege
521,222 A 6/1894 Schof et al.
620,815 A 3/1899 Warren
776,352 A 11/1904 Rogers
928,169 A 7/1909 Bardon
1,001,076 A 8/1911 Redford
1,207,649 A 12/1916 South
D56,043 S 8/1920 Weinberg et al.
(Continued)

FOREIGN PATENT DOCUMENTS

AU 702 172 2/1999
CN 2419864 Y 2/2001
(Continued)

OTHER PUBLICATIONS

Activa Leisure, 2010 Product Catalog.
(Continued)

*Primary Examiner* — Robert Canfield
(74) *Attorney, Agent, or Firm* — Knobbe, Martens, Olson & Bear, LLP

(57) ABSTRACT

Disclosed herein are embodiments of removable and/or adjustable stabilizing assemblies for stabilizing a canopy of a cantilever umbrella. A removable stabilizing assembly can have a support assembly, a first rib fixation assembly, and a first strut. The support assembly can be removably coupled to an upright pole of a cantilever umbrella assembly. The support assembly can have a base member and a first strut seat coupled to or formed as part of the base member. The first rib fixation assembly can be removably coupled to a first rib of a plurality of ribs of a canopy assembly of the cantilever umbrella assembly. The first strut can have a first end and a second end. The first end can be pivotally coupled to the base member of the support assembly by the first strut seat. The second end can be pivotally coupled to the first rib fixation assembly.

27 Claims, 23 Drawing Sheets

(56) References Cited

U.S. PATENT DOCUMENTS

| | | | |
|---|---|---|---|
| 1,589,299 | A | 6/1926 | Metzger |
| 1,630,870 | A | 5/1927 | Strunck |
| 1,712,430 | A | 5/1929 | Giszczynski |
| 1,908,453 | A | 5/1933 | Schmidt |
| 2,168,188 | A | 8/1939 | Bernhard |
| 2,183,833 | A | 12/1939 | Farhar |
| 2,185,466 | A | 1/1940 | Jostes |
| 2,235,518 | A | 3/1941 | Goshaw |
| 2,474,516 | A | 6/1949 | Daniel |
| 2,475,406 | A | 7/1949 | Russell |
| 2,507,919 | A | 5/1950 | Mazzeo |
| 2,584,283 | A | 2/1952 | Masoner |
| 2,661,752 | A | 12/1953 | Kampf et al. |
| 2,670,133 | A | 2/1954 | Volker |
| 2,705,967 | A | 4/1955 | Zimmermann et al. |
| 2,709,059 | A | 5/1955 | Lear |
| 2,721,569 | A | 10/1955 | Militano |
| 2,724,396 | A | 11/1955 | Pereira |
| 2,762,243 | A | 9/1956 | Knosp et al. |
| 2,860,647 | A | 11/1958 | Negri |
| 2,905,187 | A | 9/1959 | Croce |
| 2,906,277 | A | 9/1959 | Militano |
| 2,914,154 | A | 11/1959 | Russell |
| 3,016,910 | A | 1/1962 | Rosenkaimer |
| 3,120,238 | A | 2/1964 | Glatz |
| 3,129,715 | A | 4/1964 | Fleischer et al. |
| 3,142,307 | A | 7/1964 | Danciart et al. |
| 3,145,720 | A | 8/1964 | Torii |
| 3,150,671 | A | 9/1964 | Frey |
| 3,175,568 | A | 3/1965 | Kafka |
| 3,182,673 | A | 5/1965 | Small |
| 3,486,514 | A | 12/1969 | Prescott |
| 3,672,381 | A | 6/1972 | Kida et al. |
| 3,765,434 | A | 10/1973 | Riggs |
| 3,787,137 | A | 1/1974 | Renner |
| 3,828,805 | A | 8/1974 | Thur |
| 3,924,834 | A | 12/1975 | Young |
| 3,926,202 | A | 12/1975 | Uthemann et al. |
| 4,030,514 | A | 6/1977 | Schultes |
| 4,080,976 | A | 3/1978 | Hirai |
| 4,084,600 | A | 4/1978 | dePolo |
| 4,119,290 | A | 10/1978 | Gies |
| 4,144,900 | A | 3/1979 | Kinski |
| 4,148,164 | A | 4/1979 | Humphrey |
| 4,259,974 | A | 4/1981 | dePolo |
| 4,474,200 | A | 10/1984 | Kida |
| 4,474,201 | A | 10/1984 | Kida |
| 4,582,078 | A | 4/1986 | Ma |
| 4,586,525 | A | 5/1986 | Glatz et al. |
| 4,606,366 | A | 8/1986 | Collet |
| 4,622,987 | A | 11/1986 | Redl et al. |
| 4,650,145 | A | 3/1987 | Natzel et al. |
| 4,674,523 | A | 6/1987 | Glatz |
| 4,697,606 | A | 10/1987 | Ma |
| 4,720,071 | A | 1/1988 | Nelson et al. |
| 4,763,679 | A | 8/1988 | Lerch |
| 4,823,821 | A | 4/1989 | Day |
| 4,878,509 | A | 11/1989 | Tung |
| 4,925,142 | A | 5/1990 | Farmer |
| 5,002,081 | A | 3/1991 | Stromeyer |
| 5,029,596 | A | 7/1991 | Tung |
| 5,036,872 | A | 8/1991 | Huang |
| 5,086,797 | A | 2/1992 | Earnshaw et al. |
| 5,116,258 | A | 5/1992 | Vennik |
| 5,156,395 | A | 10/1992 | Smith |
| 5,161,764 | A | 11/1992 | Roney |
| 5,186,570 | A | 2/1993 | Graf |
| 5,213,122 | A | 5/1993 | Grady, II |
| 5,224,505 | A | 7/1993 | Wu |
| 5,232,304 | A | 8/1993 | Huang |
| 5,253,666 | A | 10/1993 | Huang |
| 5,329,953 | A | 7/1994 | Becher |
| 5,349,975 | A | 9/1994 | Valdner |
| 5,385,323 | A | 1/1995 | Garelick |
| 5,437,297 | A | 8/1995 | Crisman et al. |
| 5,483,985 | A | 1/1996 | Yu |
| 5,492,232 | A | 2/1996 | Ohm |
| 5,499,644 | A | 3/1996 | Geniele |
| 5,564,453 | A | 10/1996 | Steiner |
| 5,575,527 | A | 11/1996 | Pfister |
| 5,584,564 | A | 12/1996 | Phyle |
| 5,611,364 | A | 3/1997 | Woods et al. |
| 5,617,888 | A | 4/1997 | Wu |
| 5,632,464 | A | 5/1997 | Aberle |
| 5,640,984 | A | 6/1997 | Dubunsky |
| 5,655,557 | A | 8/1997 | Martin |
| 5,678,585 | A | 10/1997 | May |
| 5,711,333 | A | 1/1998 | Vanderminden, Sr. |
| 5,735,302 | A | 4/1998 | Saliva |
| 5,740,824 | A | 4/1998 | Tang |
| 5,746,152 | A | 5/1998 | Huse |
| 5,752,534 | A | 5/1998 | Becher |
| 5,782,256 | A | 7/1998 | Bradley |
| 5,785,069 | A | 7/1998 | Glatz |
| D398,443 | S | 9/1998 | Bolle |
| 5,842,493 | A | 12/1998 | Yakubisin |
| 5,845,665 | A | 12/1998 | Koehn |
| 5,868,152 | A | 2/1999 | Brown |
| 5,871,024 | A | 2/1999 | Vendermindern, Sr. |
| 5,882,077 | A | 3/1999 | Gebhard |
| 5,884,645 | A | 3/1999 | Chen et al. |
| 5,937,882 | A | 8/1999 | Harbaugh |
| 5,960,806 | A | 10/1999 | Steiner |
| 6,014,980 | A | 1/2000 | Glatz |
| 6,039,063 | A | 3/2000 | Lin et al. |
| 6,076,540 | A | 6/2000 | You |
| 6,082,383 | A | 7/2000 | Wilson |
| 6,092,771 | A | 7/2000 | Fich |
| 6,095,169 | A | 8/2000 | Lin et al. |
| D434,215 | S | 11/2000 | Lin |
| 6,152,156 | A | 11/2000 | Tung |
| D434,556 | S | 12/2000 | Lin |
| 6,196,244 | B1 | 3/2001 | Haddad et al. |
| 6,209,147 | B1 | 4/2001 | Wheaton |
| 6,220,261 | B1 | 4/2001 | Glatz |
| 6,311,705 | B1 | 11/2001 | Ma |
| 6,311,707 | B1 | 11/2001 | Wu et al. |
| 6,321,763 | B1 | 11/2001 | Ma |
| 6,330,886 | B1 | 12/2001 | Culver |
| 6,374,840 | B1 | 4/2002 | Ma |
| 6,386,214 | B1 | 5/2002 | Clarke |
| 6,390,107 | B1 | 5/2002 | Lin et al. |
| 6,435,444 | B1 | 8/2002 | Lin |
| 6,443,406 | B1 | 9/2002 | Frank |
| 6,446,650 | B1 | 9/2002 | Ma |
| 6,478,037 | B2 | 11/2002 | Tung |
| 6,520,192 | B1 | 2/2003 | Lo |
| 6,543,464 | B1 | 4/2003 | Grady, II |
| 6,571,403 | B2 | 6/2003 | Wheaton |
| 6,575,182 | B2 | 6/2003 | Tung |
| 6,575,183 | B2 | 6/2003 | Tung |
| D477,458 | S | 7/2003 | Goldwitz |
| 6,588,438 | B1 | 7/2003 | Steiner |
| 6,607,002 | B2 | 8/2003 | Reese |
| 6,619,306 | B2 | 9/2003 | Ma |
| 6,626,199 | B2 | 9/2003 | Lin et al. |
| 6,662,815 | B2 | 12/2003 | Tung |
| 6,761,180 | B1 | 7/2004 | Lai |
| D497,478 | S | 10/2004 | Clarke |
| D497,479 | S | 10/2004 | Yu |
| 6,820,847 | B2 | 11/2004 | Camarota et al. |
| 6,827,094 | B1 | 12/2004 | Bramwells |
| 6,837,255 | B2 | 1/2005 | Bunch et al. |
| 6,840,253 | B2 | 1/2005 | Ma |
| 6,851,823 | B2 | 2/2005 | Bilotti |
| 6,923,193 | B2 | 8/2005 | Chen |
| 6,926,019 | B2 | 8/2005 | Glatz |
| 6,945,263 | B2 | 9/2005 | Li |
| 6,948,283 | B2 | 9/2005 | Burkhart et al. |
| 6,953,043 | B2 | 10/2005 | Yu |
| 6,988,504 | B1 | 1/2006 | Goldwitz |
| D518,629 | S | 4/2006 | Ma |
| 7,108,388 | B2 | 9/2006 | Li |
| D530,022 | S | 10/2006 | Haymann et al. |

(56) References Cited

U.S. PATENT DOCUMENTS

| | | | |
|---|---|---|---|
| 7,134,442 | B2 | 11/2006 | Ma |
| 7,156,114 | B2 | 1/2007 | Lo |
| 7,207,343 | B2 | 4/2007 | Earnshaw et al. |
| 7,255,118 | B2 | 8/2007 | Vardy et al. |
| 7,318,444 | B2 | 1/2008 | Clarke |
| 7,341,068 | B2 | 3/2008 | Liu |
| 7,350,532 | B2 | 4/2008 | Wu |
| 7,380,563 | B2 | 6/2008 | Seo |
| 7,398,790 | B2 | 7/2008 | Glatz |
| 7,401,618 | B2 | 7/2008 | Caldwell |
| 7,412,985 | B2 | 8/2008 | Ma |
| 7,493,909 | B2 | 2/2009 | Ma |
| 7,520,289 | B1 | 4/2009 | Barber |
| 7,533,680 | B2 | 5/2009 | Ma |
| 7,556,051 | B2 | 7/2009 | Lai |
| 7,628,164 | B2 | 12/2009 | Ma |
| D609,453 | S | 2/2010 | Liu |
| 7,708,022 | B2 | 5/2010 | Ma |
| 7,717,121 | B2 | 5/2010 | Glatz |
| D621,600 | S | 8/2010 | He |
| 7,798,161 | B2 | 9/2010 | Ma |
| 7,866,331 | B2 | 1/2011 | Glatz |
| 7,886,755 | B2 | 2/2011 | Tung |
| 7,900,643 | B2 | 3/2011 | Ma |
| 7,913,707 | B2 | 3/2011 | Lai |
| 7,913,709 | B2 | 3/2011 | Brebner |
| 7,918,054 | B2 | 4/2011 | Grafton |
| D638,622 | S | 5/2011 | He |
| 7,963,293 | B2 | 6/2011 | Ma |
| 7,980,261 | B2 | 7/2011 | Glatz |
| 7,980,262 | B1 | 7/2011 | You |
| 8,066,021 | B2 | 11/2011 | Ma |
| 8,096,310 | B2 | 1/2012 | Clarke |
| 8,104,492 | B2 | 1/2012 | Dan |
| 8,113,223 | B2 | 2/2012 | Wang |
| 8,251,078 | B2 | 8/2012 | Ma |
| 8,356,612 | B2 | 1/2013 | Liu |
| 8,360,080 | B2 | 1/2013 | Liu et al. |
| D684,353 | S | 6/2013 | Grohs |
| 8,479,756 | B1 | 7/2013 | Tieskotter et al. |
| 8,522,804 | B1 | 9/2013 | Tung |
| 8,555,906 | B2 | 10/2013 | Ma |
| 8,607,808 | B1 | 12/2013 | You |
| 8,863,766 | B1 | 10/2014 | Kent |
| 9,004,087 | B2 | 4/2015 | Ma |
| D737,180 | S | 8/2015 | Gholston et al. |
| 9,220,325 | B2 | 12/2015 | Ma |
| 9,237,785 | B2 | 1/2016 | Ma |
| 9,289,038 | B2 | 3/2016 | Ma |
| 9,301,582 | B2 | 4/2016 | Haythornthwaite et al. |
| 9,303,427 | B1 | 4/2016 | Arndt et al. |
| 9,504,299 | B2 | 11/2016 | Ma |
| 9,528,829 | B2 | 12/2016 | Bhave et al. |
| 9,609,926 | B2 | 4/2017 | Haythornthwaite et al. |
| 9,642,421 | B2 | 5/2017 | Ma |
| 9,668,554 | B2 | 6/2017 | Haythornthwaite et al. |
| D800,025 | S | 10/2017 | Gholston |
| 9,839,268 | B2 | 12/2017 | Chen et al. |
| 9,901,149 | B2 | 2/2018 | Arndt et al. |
| 9,930,942 | B2 | 4/2018 | Ma |
| 9,957,728 | B2 | 5/2018 | Ma |
| D822,981 | S | 7/2018 | You |
| D824,160 | S | 7/2018 | You |
| 10,012,379 | B2 | 7/2018 | Xie |
| 10,092,069 | B2 | 10/2018 | Haythornthwaite et al. |
| 10,136,709 | B2 | 11/2018 | Ma |
| 10,136,710 | B2 | 11/2018 | Roberts et al. |
| D838,470 | S | 1/2019 | Liu |
| 10,264,861 | B2 | 4/2019 | Su |
| 10,368,617 | B2 | 8/2019 | Ma |
| 10,426,236 | B1 | 10/2019 | Huckvale |
| 10,455,912 | B2 | 10/2019 | Arndt et al. |
| 10,590,676 | B2 | 3/2020 | Ma et al. |
| D880,842 | S | 4/2020 | You |
| 10,716,372 | B1 | 7/2020 | Li |
| 10,835,003 | B1 | 11/2020 | Clarke et al. |
| 10,925,361 | B2 | 2/2021 | Ma |
| 11,013,303 | B2 | 5/2021 | Ma |
| 11,363,864 | B2 | 6/2022 | Clarke |
| 2002/0083969 | A1 | 7/2002 | Tung |
| 2002/0104557 | A1 | 8/2002 | Tung |
| 2002/0129847 | A1 | 9/2002 | Ma |
| 2002/0174887 | A1 | 11/2002 | Reese |
| 2002/0179130 | A1 | 12/2002 | Ko |
| 2003/0005952 | A1 | 1/2003 | Chen |
| 2003/0010366 | A1 | 1/2003 | Glatz |
| 2003/0015230 | A1 | 1/2003 | Glatz |
| 2003/0098050 | A1 | 5/2003 | Lee |
| 2003/0226582 | A1* | 12/2003 | Chen ..... A45B 25/22 135/27 |
| 2003/0226583 | A1* | 12/2003 | Chen ..... A45B 25/02 135/27 |
| 2004/0031513 | A1 | 2/2004 | Bunch et al. |
| 2004/0035452 | A1 | 2/2004 | Ma |
| 2004/0055627 | A1 | 3/2004 | Moga |
| 2004/0055628 | A1 | 3/2004 | Yu |
| 2004/0069333 | A1 | 4/2004 | Ma |
| 2004/0177871 | A1 | 9/2004 | Harbaugh |
| 2004/0182429 | A1 | 9/2004 | Chen |
| 2004/0261827 | A1 | 12/2004 | Chen |
| 2005/0013130 | A1 | 1/2005 | Li |
| 2005/0016571 | A1 | 1/2005 | Wu |
| 2005/0028852 | A1 | 2/2005 | Reese |
| 2005/0028853 | A1 | 2/2005 | Houtan |
| 2005/0041425 | A1 | 2/2005 | Li |
| 2005/0045217 | A1 | 3/2005 | Clarke |
| 2005/0183762 | A1 | 8/2005 | Ma |
| 2005/0229957 | A1 | 10/2005 | Glatz |
| 2005/0268952 | A1 | 12/2005 | Ma |
| 2005/0268953 | A1 | 12/2005 | Ma |
| 2006/0081277 | A1 | 4/2006 | Liu |
| 2006/0090784 | A1 | 5/2006 | Ma |
| 2006/0151018 | A1 | 7/2006 | Wilson |
| 2006/0169307 | A1 | 8/2006 | Lo |
| 2006/0201542 | A1 | 9/2006 | Ma |
| 2006/0243311 | A1 | 11/2006 | Glatz |
| 2006/0278262 | A1 | 12/2006 | Ma |
| 2007/0074751 | A1 | 4/2007 | Fraser |
| 2007/0163632 | A1 | 7/2007 | Chang |
| 2007/0209688 | A1 | 9/2007 | Earnshaw |
| 2008/0066791 | A1 | 3/2008 | Ma |
| 2008/0066793 | A1 | 3/2008 | Ma |
| 2008/0236640 | A1 | 10/2008 | Hauali et al. |
| 2010/0051074 | A1 | 3/2010 | Dan |
| 2010/0101614 | A1 | 4/2010 | Wang et al. |
| 2010/0192997 | A1 | 8/2010 | Liu et al. |
| 2010/0212705 | A1 | 8/2010 | Tung |
| 2010/0269871 | A1 | 10/2010 | Ma |
| 2011/0005558 | A1 | 1/2011 | Lai |
| 2011/0214705 | A1 | 9/2011 | Ma |
| 2013/0092200 | A1 | 4/2013 | May |
| 2013/0333734 | A1 | 12/2013 | Ma |
| 2014/0158173 | A1 | 6/2014 | Li et al. |
| 2014/0166060 | A1 | 6/2014 | Ma |
| 2014/0230867 | A1 | 8/2014 | Ma |
| 2014/0311537 | A1 | 10/2014 | Ma |
| 2015/0059815 | A1 | 3/2015 | Xiong |
| 2015/0068567 | A1 | 3/2015 | Ma |
| 2016/0183647 | A1 | 6/2016 | Ma |
| 2018/0112433 | A1 | 4/2018 | Ma |
| 2018/0184770 | A1 | 7/2018 | Hendrix et al. |
| 2019/0323258 | A1 | 10/2019 | Ma |
| 2020/0060396 | A1 | 2/2020 | Ma |

FOREIGN PATENT DOCUMENTS

| | | | |
|---|---|---|---|
| CN | 2441342 | Y | 8/2001 |
| CN | 2621472 | Y | 6/2004 |
| CN | 2843147 | Y | 12/2006 |
| CN | 2896981 | | 5/2007 |
| CN | 201001460 | Y | 1/2008 |
| CN | 201001463 | Y | 1/2008 |
| CN | 201076109 | Y | 6/2008 |
| CN | 201135192 | Y | 10/2008 |

(56) References Cited

FOREIGN PATENT DOCUMENTS

| | | |
|---|---|---|
| CN | 201197439 Y | 2/2009 |
| CN | 201207982 Y | 3/2009 |
| CN | 201518827 U | 7/2010 |
| DE | 580503 | 7/1933 |
| DE | 2259192 | 6/1974 |
| DE | 3229776 | 4/1983 |
| DE | 3820573 | 8/1989 |
| DE | 203 06 406 | 7/1994 |
| DE | 297 12 024 | 9/1997 |
| DE | 298 04 884 | 6/1998 |
| DE | 299 06 116 | 8/1999 |
| DE | 20205561 | 7/2002 |
| DE | 20 2005 011579 | 7/2006 |
| DE | 10 2008 034 985 | 2/2010 |
| EP | 0 392 989 | 10/1990 |
| EP | 1 400 186 | 3/2004 |
| EP | 1 654 952 | 5/2006 |
| EP | 1 700 536 | 9/2006 |
| EP | 2 103 230 | 9/2009 |
| EP | 2 425 738 | 3/2012 |
| FR | 2 554 490 | 5/1985 |
| FR | 2 687 714 | 8/1993 |
| GB | 22218 | 9/1911 |
| JP | 5031003 | 2/1993 |
| NL | 9 500 219 | 9/1996 |
| WO | WO 97/04682 | 2/1997 |
| WO | WO 00/55456 | 9/2000 |
| WO | WO 05/018369 | 7/2004 |
| WO | WO 2006/076270 | 7/2006 |
| WO | WO 2007/018492 | 2/2007 |
| WO | WO 2015/186135 | 12/2015 |
| WO | WO 2019/100393 | 5/2019 |
| WO | WO 2019/169454 | 9/2019 |

OTHER PUBLICATIONS

Ocean Master MAX Single Cantilever, Premium Parasolas, TUUCI, v. 06.13.17, in 1 page.

Operation Manual Easy Sun Parasol Sunshade (Issue: Jul. 2004) pp. 1-17.

Treasure Garden, 2010 Product Catalog.

Treasure Garden's product brochure identified as "AG3 9' Centilever Umbrella", p. 2.

* cited by examiner

CANTILEVER UMBRELLA WITH STABILIZING ASSEMBLY

INCORPORATION BY REFERENCE TO ANY PRIORITY APPLICATIONS

Any and all applications for which a foreign or domestic priority claim is identified in the Application Data as filed with the present application are hereby incorporated by reference under 37 CFR 1.57.

BACKGROUND

Field

This application is directed to umbrella assemblies, specifically cantilever umbrellas, having a stabilizing assembly configured to assist in supporting a canopy assembly.

Description of the Related Art

Cantilever style umbrellas have a support pole that is positioned off-center relative to a canopy assembly. Such an arrangement can be beneficial, for example, because it can provide for additional usable space beneath the canopy assembly that would otherwise be taken up by a support pole in a center-supported umbrella. The off-center positioning can make providing adequate support to the canopy assembly more complicated, however.

SUMMARY

The present disclosure describes various embodiments of removable and/or adjustable stabilizing assemblies for stabilizing a canopy assembly of a cantilever umbrella assembly. The stabilizing assemblies disclosed herein can provide a number of benefits, such as providing additional or auxiliary support to a canopy assembly of a cantilever umbrella, helping to stabilize the canopy, particularly in windy environments. Various embodiments disclosed herein can be removable and/or relatively easily installed onto a cantilever umbrella assembly. This can be beneficial, for example, because the assembly does not need to be installed when wind stabilization is not needed, thus reducing the complexity of deploying the umbrella, increasing the aesthetics of the umbrella, and/or the like in situations where additional wind stabilization is not needed. In situations where wind stabilization is desired, however, various embodiments of stabilization assemblies disclosed herein can be relatively easily added to or installed onto the cantilever umbrella assembly in order to provide additional wind stabilization. Additionally, various embodiments of stabilization assemblies disclosed herein include a variety of adjustments that enable the assembly to be used with a variety of umbrella assemblies, with an umbrella assembly in a variety of configurations or positions, and/or the like.

In one embodiment, an umbrella assembly is provided that includes an upright pole, a canopy assembly, a frame assembly, and an adjustable stabilizing assembly. The upright pole extends along a longitudinal direction. The canopy assembly includes a hub and a plurality of ribs extending from the hub. The plurality of ribs are configured to support a cover in a deployed configuration. The frame assembly connects the canopy assembly to the upright pole in a cantilever manner. The frame assembly includes a cantilever beam coupled at a first end to the upright pole, and at a second end to the hub of the canopy assembly. The adjustable stabilizing assembly is for stabilizing the canopy assembly with respect to the upright pole. The adjustable stabilizing assembly includes a support assembly and a first adjustable length strut. The support assembly slidably coupled to the upright pole such that the support assembly can be fixed with respect to the upright pole at a plurality of positions along the longitudinal direction. The support assembly includes a base member and a first strut seat coupled to or formed as part of the base member. The first adjustable length strut has a first end and a second end. The first end of the first adjustable length strut is pivotally coupled to the base member of the support assembly by the first strut seat. The second end of the first adjustable length strut is pivotally coupled to a first rib of the plurality of ribs of the canopy assembly.

In some embodiments, the support assembly further comprises a second strut seat coupled to or formed as part of the base member and the adjustable stabilizing assembly further includes a second adjustable length strut having a first end and a second end. The first end of the second adjustable length strut is pivotally coupled to the base member of the support assembly by the second strut seat. The second end of the second adjustable length strut is pivotally coupled to a second rib of the plurality of ribs of the canopy assembly.

In some embodiments, the adjustable stabilizing assembly further includes a first rib fixation assembly that is slidably coupled to the first rib and can be fixed with respect to the first rib at a plurality of positions along a length of the first rib. The second end of the first adjustable length strut is pivotally coupled to the first rib by the first rib fixation assembly.

In some embodiments, the support assembly is removable from the upright pole and the first rib fixation assembly is removable from the first rib.

In some embodiments, the first rib fixation assembly is removable from the first rib by pivoting a first member of the first rib fixation assembly away from a second member of the first rib fixation assembly.

In some embodiments, a clamp mechanism is configured to selectively maintain the first member and the second member in a closed configuration.

In some embodiments, the upright pole includes a channel extending along the longitudinal direction, with at least a portion of the support assembly extending through the channel into an internal cavity of the upright pole. The upright pole includes a rack positioned within the internal cavity and extending along the longitudinal direction. The support assembly further includes a spring-loaded pawl and a positioning knob. The spring-loaded pawl includes one or more teeth shaped to engage the rack of the upright pole. The spring-loaded pawl being biased toward engagement of the one or more teeth with the rack. The positioning knob is operable to overcome the biasing of the spring-loaded pawl to selectively disengage the one or more teeth from the rack. The spring-loaded pawl is configured to limit movement of the support assembly with respect to the upright pole with the one or more teeth engaged with the rack. The spring-loaded pawl is configured to not limit movement of the support assembly with respect to the upright pole with the one or more teeth not engaged with the rack.

In some embodiments, the positioning knob is coupled to a shaft of the spring-loaded pawl, such that pulling the positioning knob in a direction away from the rack will cause the one or more teeth to be pulled in the direction away from the rack.

In some embodiments, the shaft of the spring-loaded pawl includes a pin extending laterally from the shaft. The base member of the support assembly includes an opening that allows the pin to pass therethrough with the positioning knob and shaft in a first rotational orientation. The base member of the support assembly includes a blocking portion that engages the pin to limit movement of the one or more teeth toward the rack with the positioning knob and shaft in a second rotational orientation.

In some embodiments, the frame assembly further includes a pinion gear that engages the rack. The pinion gear is configured such that rotation of the pinion gear with respect to the rack will adjust a position of the first end of the cantilever beam with respect to the upright pole along the longitudinal direction.

In some embodiments, the support assembly further includes a clamping block and a clamping knob. The clamping block is positioned within the internal cavity of the upright pole. The clamping knob is operable to selectively force the clamping block against a surface of the internal cavity of the upright pole to selectively maintain the support assembly in a fixed position with respect to the upright pole.

In some embodiments, the support assembly further includes a threaded shaft coupled to the clamping knob and the clamping block, such that rotation of the clamping knob with respect to the clamping block will cause the clamping knob and clamping block to be forced toward or away from one another.

In some embodiments, the first adjustable length strut includes a first tubular member and a collet. The first tubular member is slideably coupled to a second tubular member in a telescoping arrangement. The collet selectively permits or restricts telescoping of the first tubular member with respect to the second tubular member.

In some embodiments, the support assembly is coupled to the upright pole at a position below where the first end of the cantilever beam is coupled to the upright pole.

In another embodiment an umbrella assembly is provided that includes an upright pole, a canopy assembly, a frame assembly, and a removable stabilizing assembly. The upright pole extends along a longitudinal direction. The canopy assembly includes a hub and a plurality of ribs extending from the hub. The plurality of ribs are configured to support a cover in a deployed configuration. The frame assembly connects the canopy assembly to the upright pole in a cantilever manner. The frame assembly includes a cantilever beam. The cantilever beam is coupled at a first end to the upright pole and at a second end to the hub of the canopy assembly. The removable stabilizing assembly stabilizes the canopy assembly with respect to the upright pole. The removable stabilizing assembly includes a support assembly, a first rib fixation assembly, and a first strut. The support assembly is removably coupled to the upright pole. The support assembly includes a base member and a first strut seat coupled to or formed as part of the base member. The first rib fixation assembly is removably coupled to a first rib of the plurality of ribs of the canopy assembly. The first strut has a first end and a second end. The first end of the first strut is pivotally coupled to the base member of the support assembly by the first strut seat. The second end of the first strut is pivotally couple to the first rib fixation assembly.

In some embodiments, the support assembly further includes a second strut seat coupled to or formed as part of the base member. The removably stabilizing assembly further includes a second rib fixation assembly and a second strut. The second rib fixation assembly is removably coupled to a second rib of the plurality of ribs of the canopy assembly. The second strut having a first end and a second end. The first end of the second strut is pivotally coupled to the base member of the support assembly by the second strut seat. The second end of the second strut is pivotally coupled to the second rib fixation assembly.

In some embodiments, the upright pole comprises a channel extending along the longitudinal direction, with at least a portion of the support assembly extending through the channel into an internal cavity of the upright pole. The support assembly further includes a clamping block positioned within the internal cavity of the upright pole. The clamping block includes at a first orientation with respect to the base member and a second orientation with respect to the base member. In the first orientation, the clamping block is configured to clamp a wall of the upright pole between the clamping block and the base member. In the second orientation, the clamping block is configured to be passable through the channel to enable removal of the support assembly from the upright pole.

In some embodiments, the first rib fixation assembly includes a first member, a second member, and a clamp mechanism. The first member is shaped to at least partially wrap around the first rib. The second member is pivotally coupled to the first member. The second member pivotable with respect to the first member between an open configuration and a closed configuration. In the open configuration, the first rib fixation assembly can be coupled to or removed from the first rib, and, in the closed configuration, the first rib fixation assembly is fixed to the first rib. The clamp mechanism is configured to selectively maintain the second member in the closed configuration.

In some embodiments, the clamp mechanism comprises a quick release buckle.

In some embodiments, the support assembly is coupled to the upright pole at a position below where the first end of the cantilever beam is coupled to the upright pole.

In some embodiments, the support assembly is slidably coupled to the upright pole such that the support assembly can be fixed with respect to the upright pole at a plurality of positions along the longitudinal direction. The first strut is an adjustable length strut and the first rib fixation assembly is slidably coupled to the first rib such that the first rib fixation assembly can be fixed with respect to the first rib at a plurality of positions along a length of the first rib.

In some embodiments, the removable stabilizing assembly is removable without disassembling the frame assembly or the canopy assembly.

In some embodiments, the support assembly is removable from the upright pole in a direction transverse to a longitudinal axis of the upright pole.

In some embodiments, the first rib fixation assembly is removable from the first rib in a direction transverse to a longitudinal axis of the first rib.

In another embodiment, a removable stabilizing assembly for stabilizing a canopy assembly of a cantilever umbrella assembly is provided that includes a support assembly, a first rib fixation assembly, and a first strut. The support assembly is removably coupleable to an upright pole of a cantilever umbrella assembly. The support assembly includes a base member and a first strut seat coupled to or formed as part of the base member. The first rib fixation assembly is removably coupleable to a first rib of a plurality of ribs of a canopy assembly of the cantilever umbrella assembly. The first strut has a first end and a second end. The first end of the first strut is pivotally coupled to the base member of the support assembly by the first strut seat. The second end of the first strut is pivotally coupled to the first rib fixation assembly.

In some embodiments, the support assembly further includes a clamping block comprising at least a first orientation with respect to the base member and a second orientation with respect to the base member. In the first orientation, the clamping block is configured to clamp a wall of an upright pole between the clamping block and the base member. In the second orientation, the clamping block is configured to be passable through a channel of the upright pole to enable removal of the support assembly from the upright pole.

In some embodiments, the first rib fixation assembly includes a first member, a second member, and a clamp mechanism. The first member is shaped to at least partially wrap around the first rib. The second member is pivotally coupled to the first member. The first member pivotable with respect to the first member between an open configuration and a closed configuration. In the open configuration, the first rib fixation assembly can be coupled to or removed from the first rib, and, in the closed configuration, the first rib fixation assembly is configured to be fixed to the first rib. The clamp mechanism is configured to selectively maintain the second member in the closed configuration.

In another embodiment, a cantilever umbrella is proved that includes an upright pole, a shade assembly, and an adjustable stabilizing assembly. The shade assembly is coupled to the upright pole. The adjustable stabilizing assembly includes a first support strut and a second support strut. The first support strut has an adjustable length. A first end of the first support strut is coupled to a fixation assembly on a first rib of the shade assembly. A positioning fixation assembly being adjustable along a length of the first rib. A second end of the first support strut coupled to a support assembly that is coupled to the upright pole. The second support strut has an adjustable length. A first end of the second support strut is coupled to a fixation assembly on a second rib of the shade assembly. A positioning of the fixation assembly being adjustable along a length of the second rib. A second end of the second support strut coupled to the support assembly. The support assembly is slidably coupled to the upright pole, to enable adjustment of positioning of the second end of the first strut and the second end of the second strut with respect to the upright pole.

In another embodiment, a cantilever umbrella assembly is provided that includes an upright pole, a shade assembly, and a stabilizing assembly. The shade assembly is coupled to the upright pole. The stabilizing assembly includes one or more support struts. Each of the one or more support struts coupled at a first end to a fixation member or assembly moveable along a rib of the shade assembly and at a second end to a support member slideably coupled to the upright pole. The support member is configured to adjust positioning of the second ends of the one or more support struts with respect to the upright pole.

In another embodiment, a cantilever umbrella assembly is provided that includes an upright pole, a shade assembly, and an adjustable wind brace. The shade assembly is coupled to the upright pole. The adjustable wind brace is configured to at least partially support the shade assembly. The adjustable wind brace extends from a slider positioned on the upright pole and coupled to at least two ribs of the shade assembly. A configuration of the adjustable wind brace is adjustable along a length of the upright pole and along a length of the at least two ribs.

BRIEF DESCRIPTION OF THE DRAWINGS

Features of the inventions can be better understood from the following detailed description when read in conjunction with the accompanying schematic drawings, which are for illustrative purposes only. The drawings include the following figures:

FIG. 8I is a perspective view of the rib fixation assembly of FIG. 8A having a first member pivotably rotated relative to a second member in an open configuration;

DETAILED DESCRIPTION

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

Cantilever style umbrellas have a support pole that is positioned off center relative to a canopy or canopy assembly. The off-centered nature of a cantilever umbrella can cause the canopy assembly to need additional support, especially in scenarios where extreme outdoor elements, such as wind or rain, can apply forces to the canopy assembly above what would be expected on a typical, less windy day. Accordingly, there is a desire for improved support assemblies to support the canopy assembly, in particular on windy days.

The present disclosure describes various embodiments of improved support or stabilizing assemblies for cantilever style umbrellas. The embodiments presented herein have a variety of benefits over prior support assemblies. For example, some embodiments are removable, and the removability of the stabilizing assembly is advantageous in that it allows the stabilizing assembly to be removed prior to closing the umbrella assembly which eliminates any interference with closing the umbrella. It can also be advantageous, because when the stabilizing assembly is not needed, the aesthetics of the umbrella can be improved by not having the stabilizing assembly installed. Additionally, some embodiments are adjustable, and the adjustability of the stabilizing assembly allows for the assembly to be used with a variety of different umbrellas, with a particular umbrella in a plurality of different configurations, and/or the like. In particular, the stabilizing assemblies can have one or more adjustable features, for example, adjustable positioning along ribs, adjustable lengths of struts, and/or adjustable positioning along the upright pole of the umbrella assembly, which can further enable the assemblies to be used with a wider variety of cantilever style umbrellas.

Figure 1:
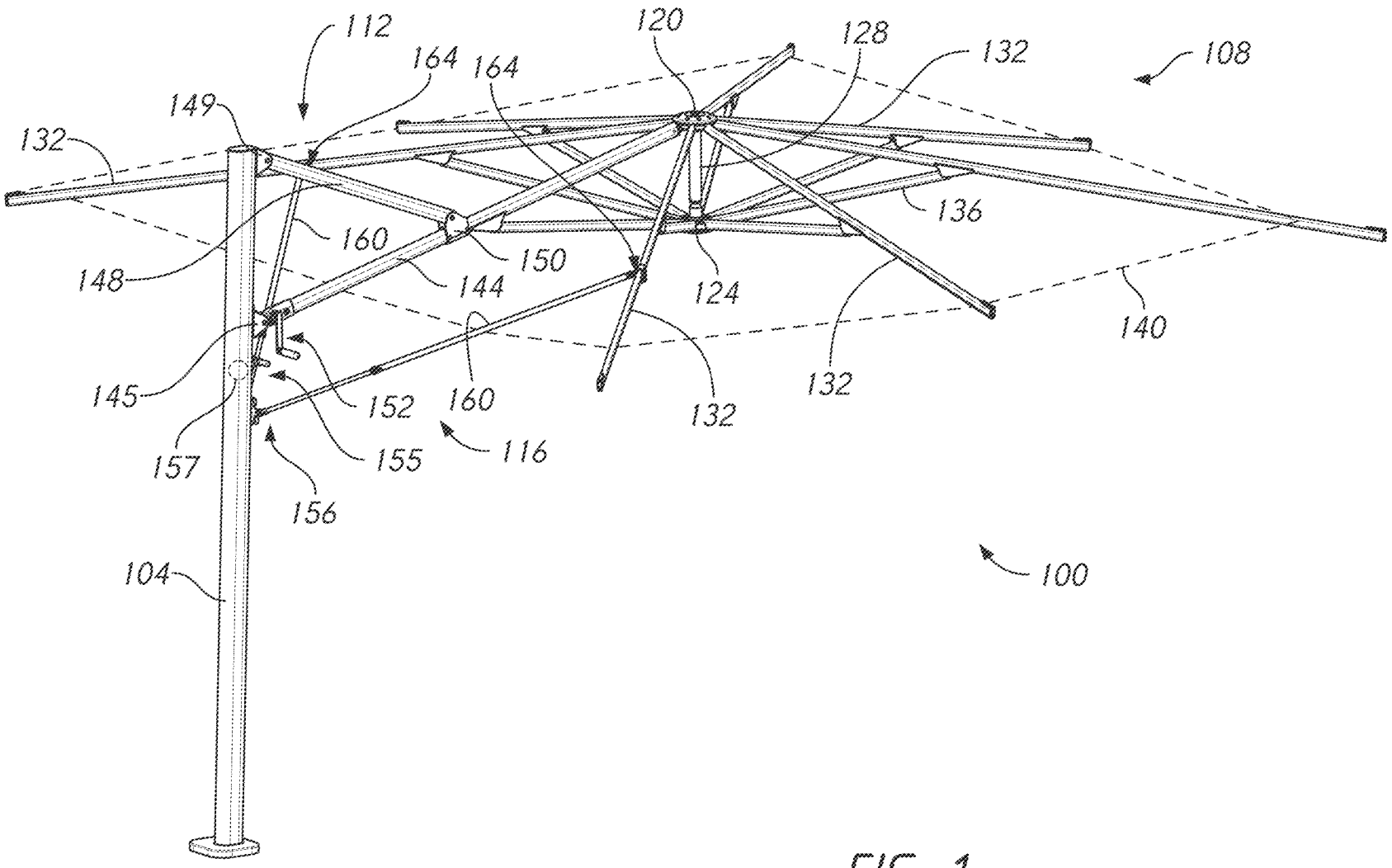
FIG. 1 is a perspective view of a cantilever umbrella including an upright pole, a canopy assembly, a frame assembly, and an adjustable and/or removable stabilizing assembly.

FIG. 1 shows an umbrella assembly 100 having an upright pole 104, a canopy assembly 108, a frame assembly 112, and an adjustable and/or removable stabilizing assembly 116. The upright pole 104 can extend in a longitudinal direction and be off-centered relative to the canopy assembly 108, such that the umbrella assembly 100 is a cantilever style umbrella. The stabilizing assembly 116 can be removable from the umbrella assembly, for example, the stabilizing assembly 116 can be attached to the umbrella assembly 100 once the umbrella assembly 100 is an open state and removed from the umbrella assembly 100 prior to transitioning the umbrella assembly 100 to a closed state. Such functionality is not required in all embodiments, but can be beneficial.

The canopy assembly 108 can include an upper hub 120 and a lower hub 124. The upper hub 120 and the lower hub 124 can be connected via an extendable pole 128. The extendable pole 128 can extend and retract as the umbrella assembly 100 is transitioned between an open and closed positioned according to the present disclosure. The canopy assembly 108 can include a plurality of ribs 132. The ribs 132 can be coupled at a first end to the upper hub 120. The canopy assembly 108 can include a plurality of struts 136. The struts 136 can be coupled at a first end to the lower hub 124 and at a second end to a location along a length of a corresponding rib 132. The canopy assembly 108 can include a canopy or cover 140 that can be supported by the canopy assembly 108 when in a deployed or open configuration.

The frame assembly 112 can connect the canopy assembly 108 to the upright pole 104. The frame assembly 112 can include a cantilever beam 144 coupled at a first end to the upright pole 104 and at a second end to the upper hub 120 of the canopy assembly 108. The frame assembly 112 can include a cantilever support beam 148 coupled at a first end at or near a top of the upright pole 104 and at a second end to a location along a length of the cantilever beam 144. The cantilever beam 144 can be coupled to the upright pole 104 via a sliding connection member 145. The cantilever support beam 148 can be coupled to the upright pole 104 via a fixed connection member 149. The fixed connection member 149 can be configured to allow the cantilever support beam 148 to rotate up and down as the sliding connection member 145 moves up and down the upright pole 104. In some embodiments, there may also be a sliding connection member or sleeve 150 that enables an outside surface of the cantilever beam 144 to slide through the sliding connection member 150.

A combined or integrated mechanism 152 is disposed within the end of the cantilever beam 144 adjacent to the upright pole 104. The integrated mechanism 152 can be configured to control multiple aspects of the umbrella assembly 100, e.g., to control tilt and clutch functions of the cantilever beam 144. In some embodiments, the combined clutch and tilt mechanism 152 extends through the length of the cantilever beam 144. The combined clutch and tilt mechanism 152 may be operated by a handle disposed on the cantilever beam 144. In some embodiments, the combined or integrated mechanism 152 may be similar to or the same as the combined or integrated mechanisms of U.S. Pat. No. 9,930,942, titled Cantilever Umbrella With Integrated Control Mechanisms, issued Apr. 3, 2018, which is hereby incorporated by reference herein in its entirety.

An integrated deployment mechanism 155 for opening/closing the frame assembly 112 and extending/retracting the cantilever beam 144 is moveably attached to the upright pole 104 such that the integrated deployment mechanism 155 can move, e.g., slide, up and down the upright pole 104 as the cantilever beam 144 is extended and retracted. In some embodiments, the cantilever beam 144 can be extendable (e.g., slideable) through the sliding connection member 150 between extended and retracted configurations. The extended configuration generally corresponds to an open position of the frame assembly 112. The retracted configuration generally corresponds to a closed position of the frame assembly 112.

The integrated deployment mechanism 155 can include a first mechanism, for example a pinion gear (represented by the circle 157 shown in dashed lines in FIG. 1), that is configured to engage a rack (e.g., rack 228 discussed below and shown in, for example, FIG. 4). Rotation of a handle of the integrated deployment mechanism 155 can cause rotation of the pinion gear which can cause the integrated deployment mechanism 155 to travel vertically upward and downward along the upright pole 104. For example, the integrated deployment mechanism may be similar to or the same as the integrated deployment mechanism of the '942 patent. In some embodiment, the integrated deployment mechanism 155 may engage the rack (e.g., rack 228 shown in FIG. 4) with a pawl, similar to pawl 184 shown in FIG. 5 and discussed below, instead of using a pinion gear.

Figure 2:
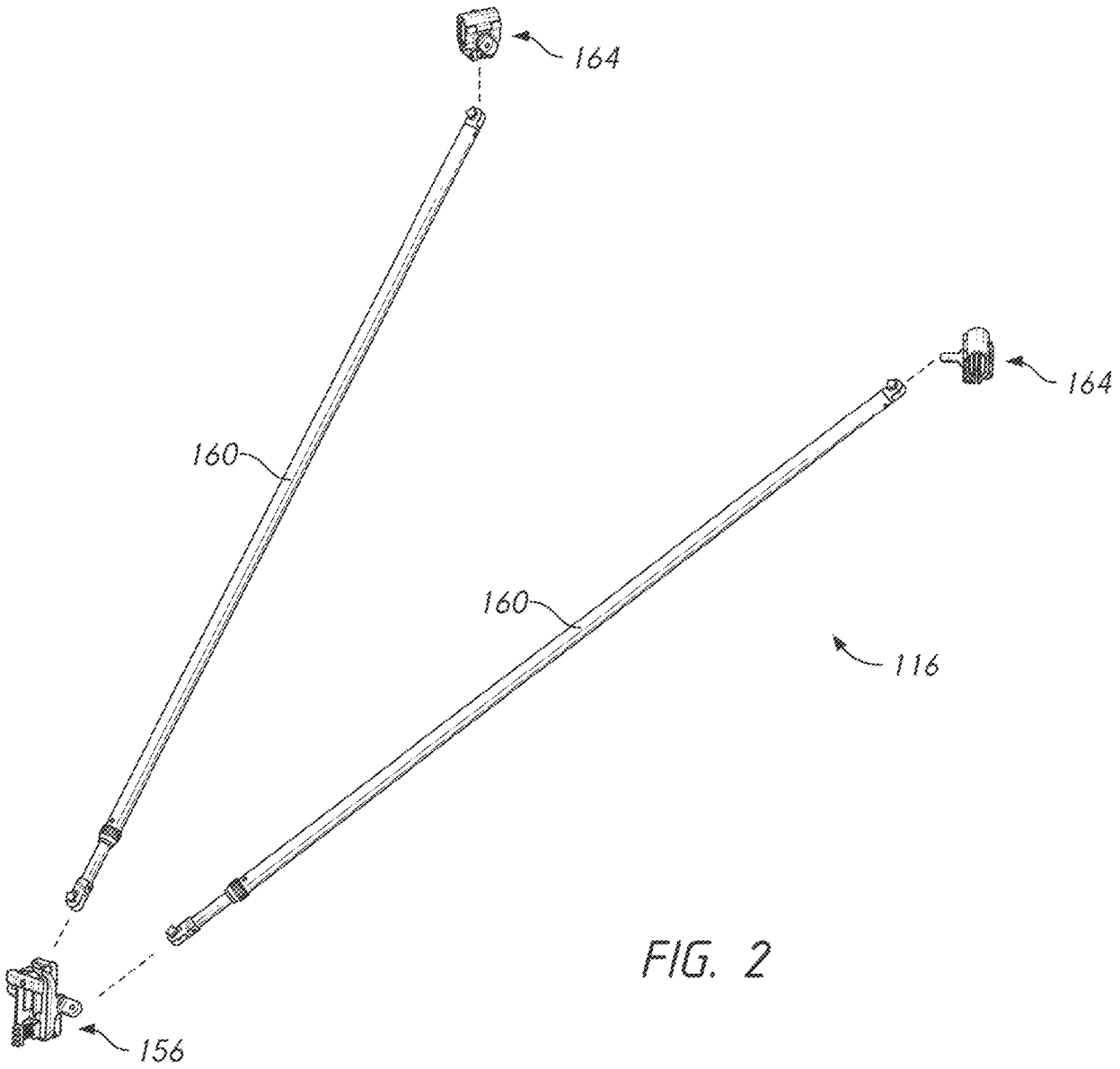
FIG. 2 is an exploded perspective view of the stabilizing assembly of FIG. 1.

FIG. 2 is an exploded perspective view of the stabilizing assembly 116 of FIG. 1, removed from the rest of the umbrella assembly 100, with dashed lines showing the portions of the stabilizing assembly 116 that will be assembled together before and/or during attachment of the stabilizing assembly 116 to the umbrella assembly 100. With reference to FIGS. 1 and 2, the stabilizing assembly 116 can assist in stabilizing the canopy assembly 108 with respect to the upright pole 104. In some embodiments, the stabilizing assembly 116 can be coupled to the upright pole 104 at a position below where the first end of the cantilever beam 144 is coupled to the upright pole 104. The stabilizing assembly 116 can include a support assembly or upright pole connection component 156 and at least one strut or rod 160. The support assembly 156 can be slidably coupled to the upright pole 104. In some embodiments, the stabilizing assembly 116 can include two struts 160, as shown in FIG. 2. In some embodiments, the struts 160 have adjustable lengths, and the adjustable length strut(s) 160 can be coupled at a first end to the support assembly 156 and coupled at a second end to one of the plurality of ribs 132. In some embodiments, the strut(s) 160 can be coupled at the second end to a rib fixation assembly or sliding seat component 164 that is coupled to one of the plurality of ribs 132. In embodiments having more than one strut 160, each strut 160 can be coupled to a different rib 132.

Example Support Assembly

Figure 3B:
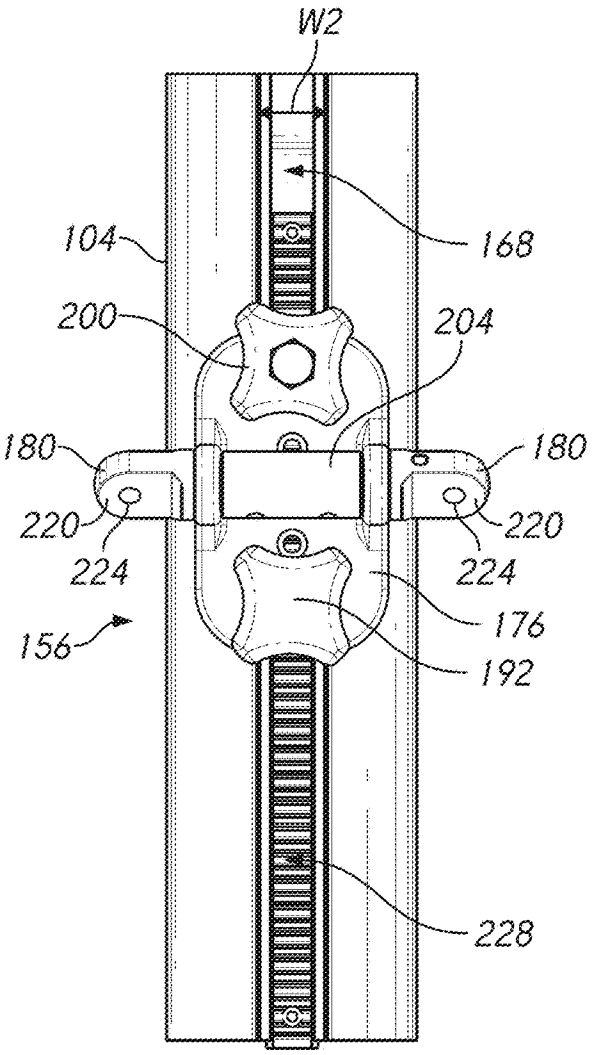
FIG. 3B is a front view of the support assembly of FIG. 3A slidably coupled to the upright pole.
Figure 3A:
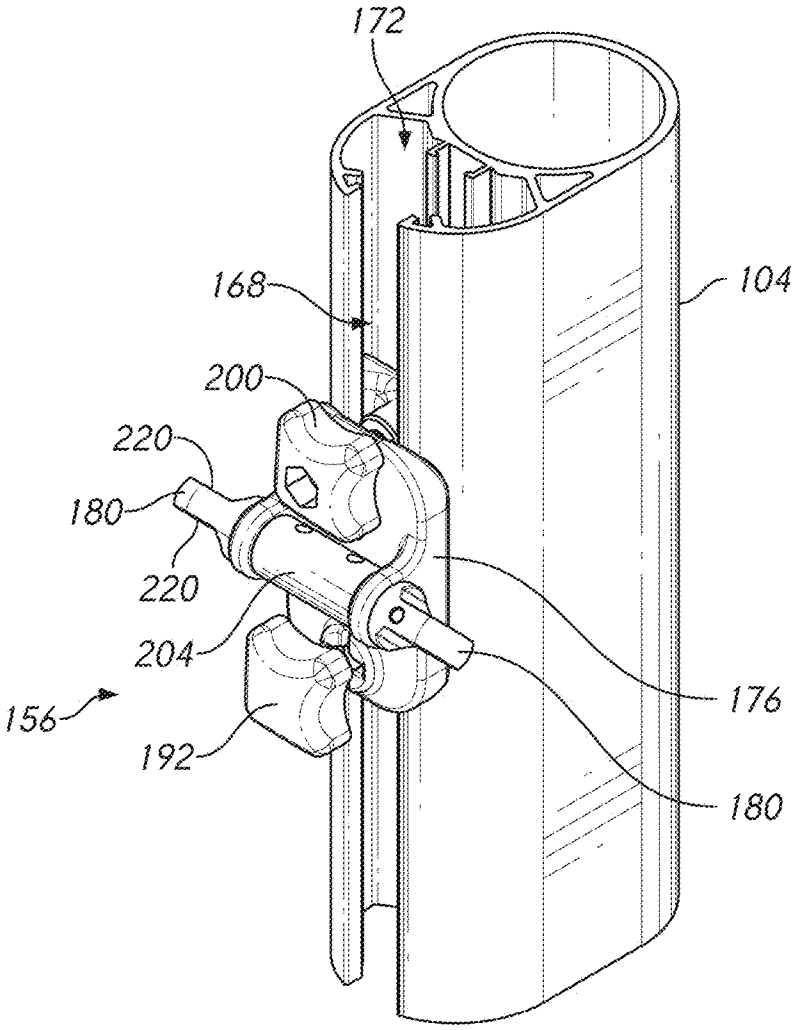
FIG. 3A is a perspective view of a support assembly of the stabilizing assembly of FIG. 1 slidably coupled to the upright pole.
Figure 3D:
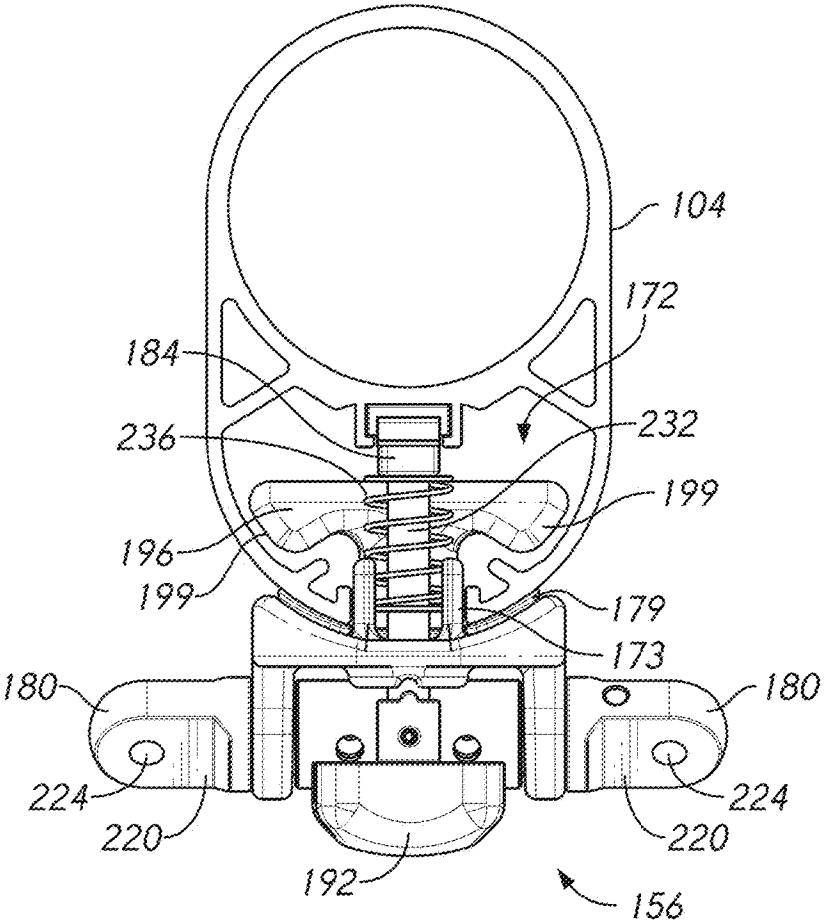
FIG. 3D is a bottom view of the support assembly of FIG. 3A slidably coupled to the upright pole.
Figure 3C:
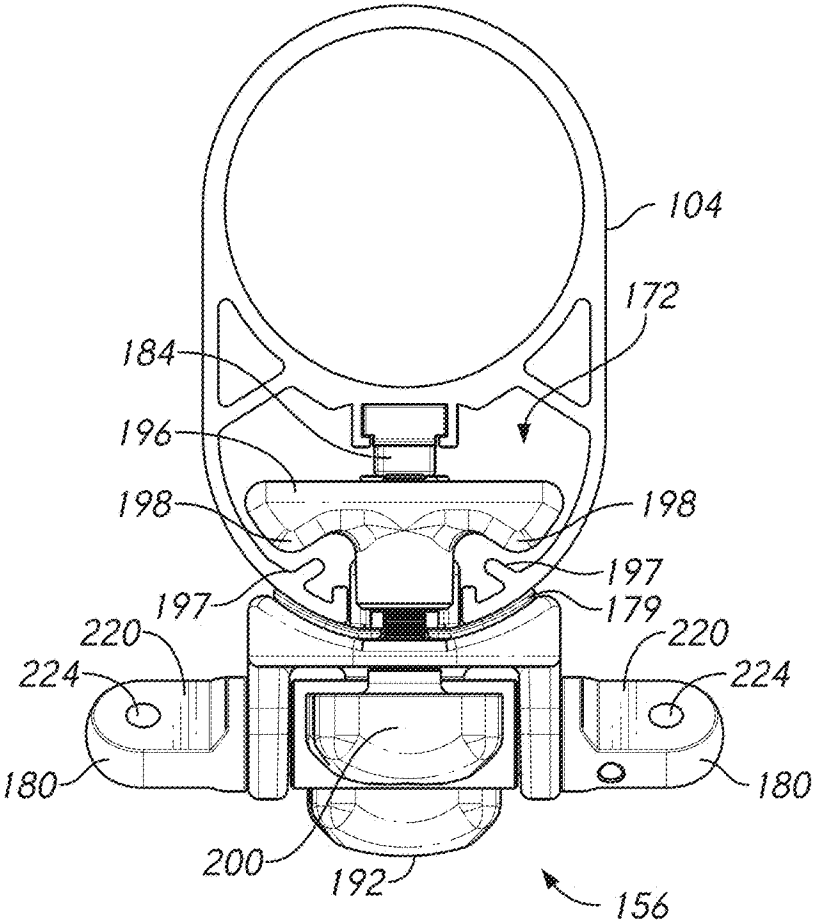
FIG. 3C is a top view of the support assembly of FIG. 3A slidably coupled to the upright pole.
Figure 3E:
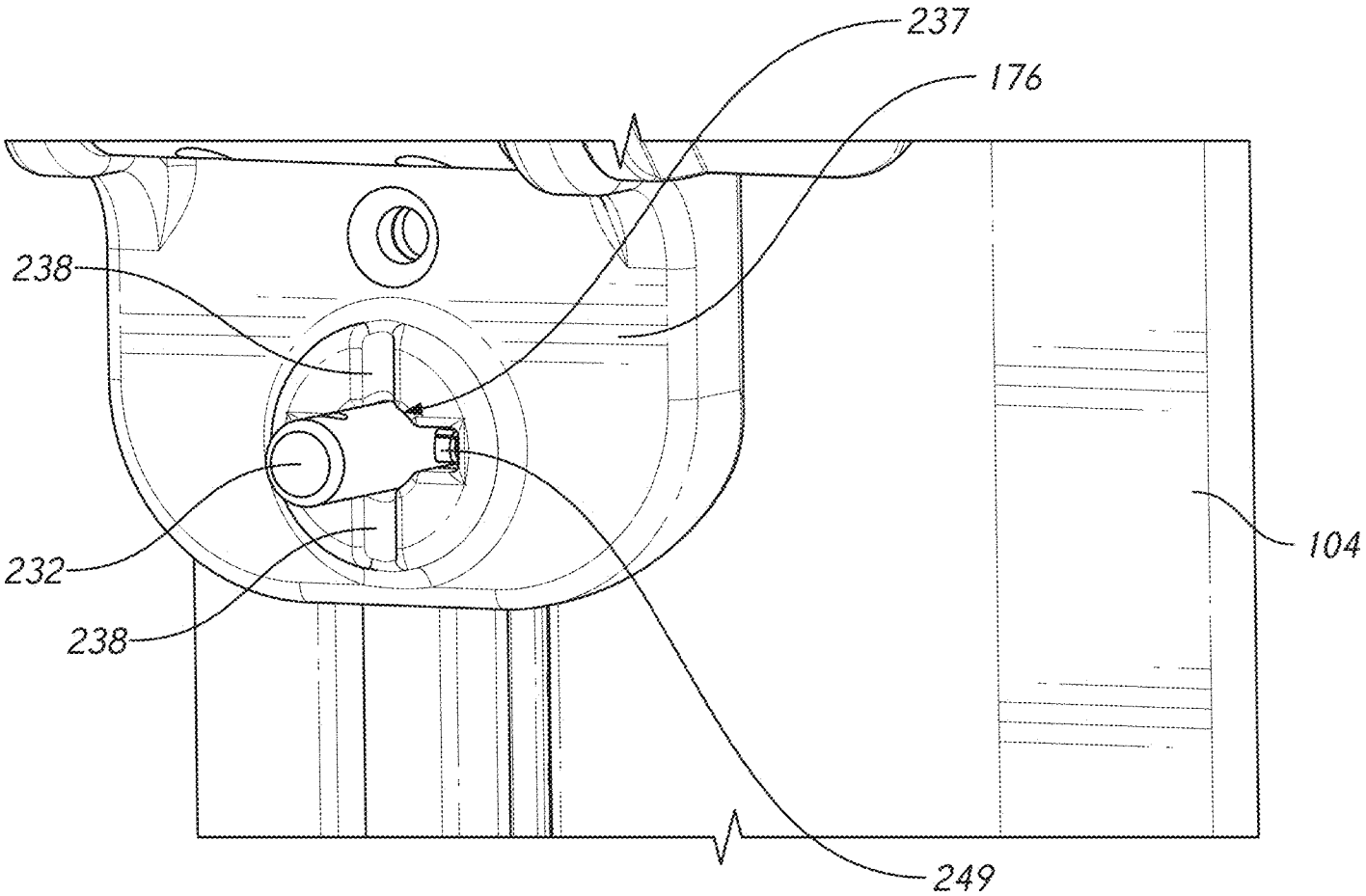
FIG. 3E is a perspective view of a portion of the support assembly of FIG. 3A slidably coupled to the upright pole, with a shaft of the support assembly in a first configuration, and with a positioning knob of the support assembly removed for illustrative purposes.
Figure 3F:
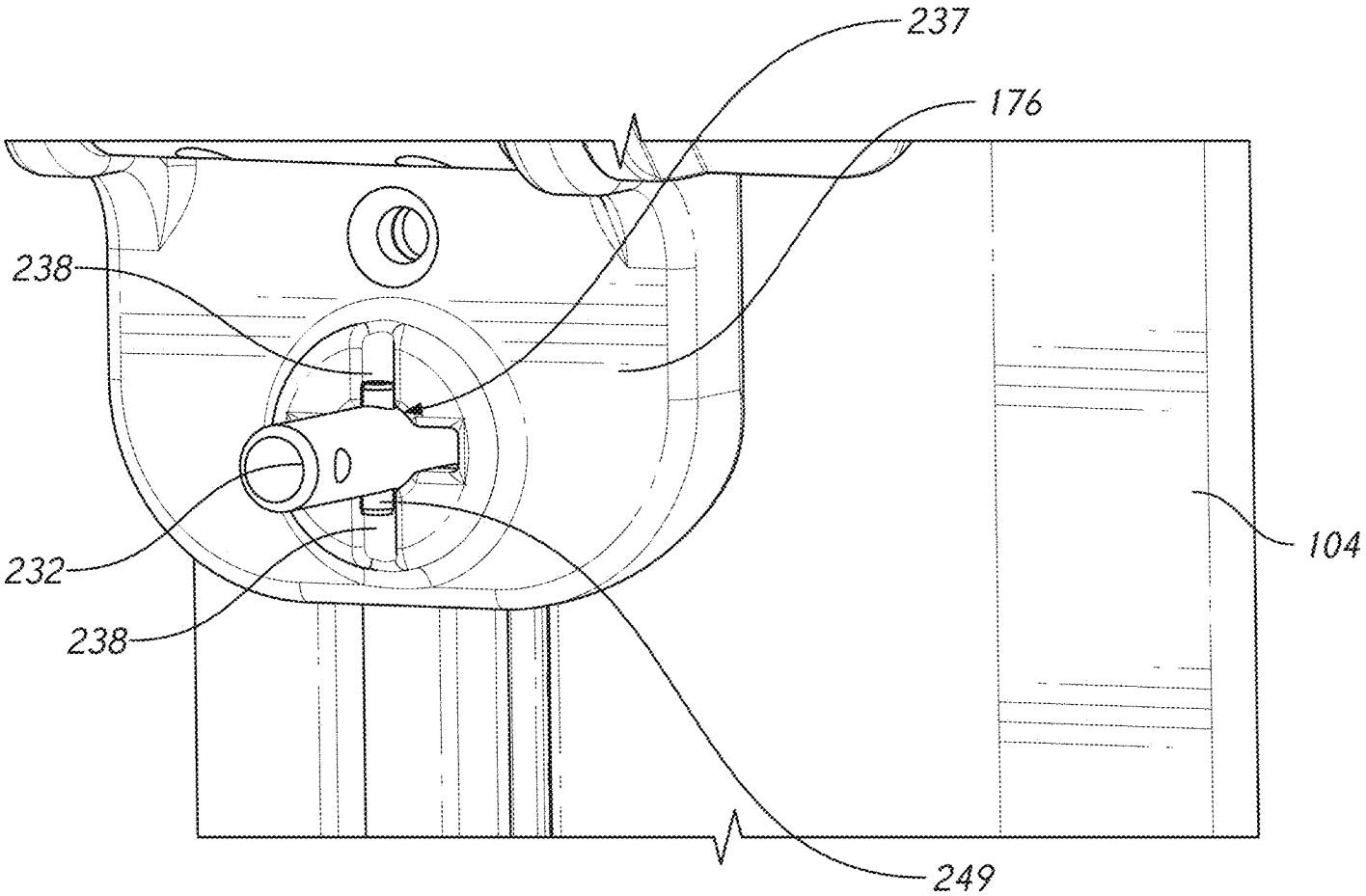
FIG. 3F is a perspective view of a portion of the support assembly of FIG. 3A slidably coupled to the upright pole, with the shaft in a second configuration, and with the positioning knob removed for illustrative purposes.
Figure 5:
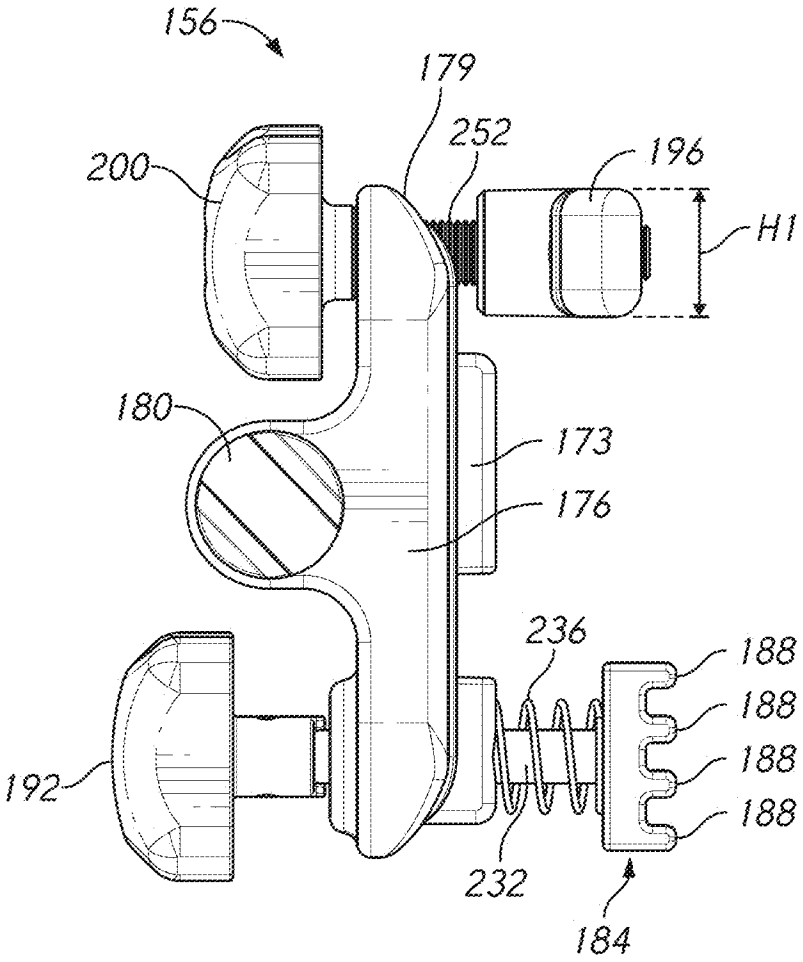
FIG. 5 is a side view of the support assembly of FIG. 3A removed from the upright pole to show a pawl having one or more teeth to engage the rack.
Figure 4:
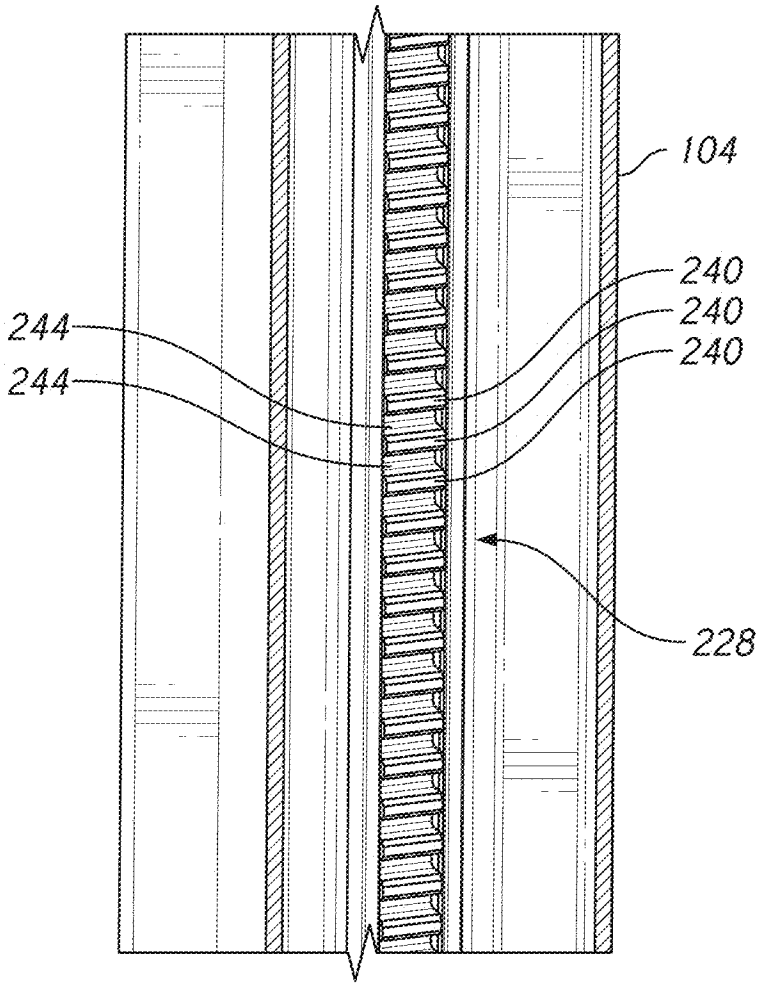
FIG. 4 is a perspective view of a portion of the upright pole with the support assembly removed to show a rack positioned within an internal cavity of the upright pole.
Figure 6B:
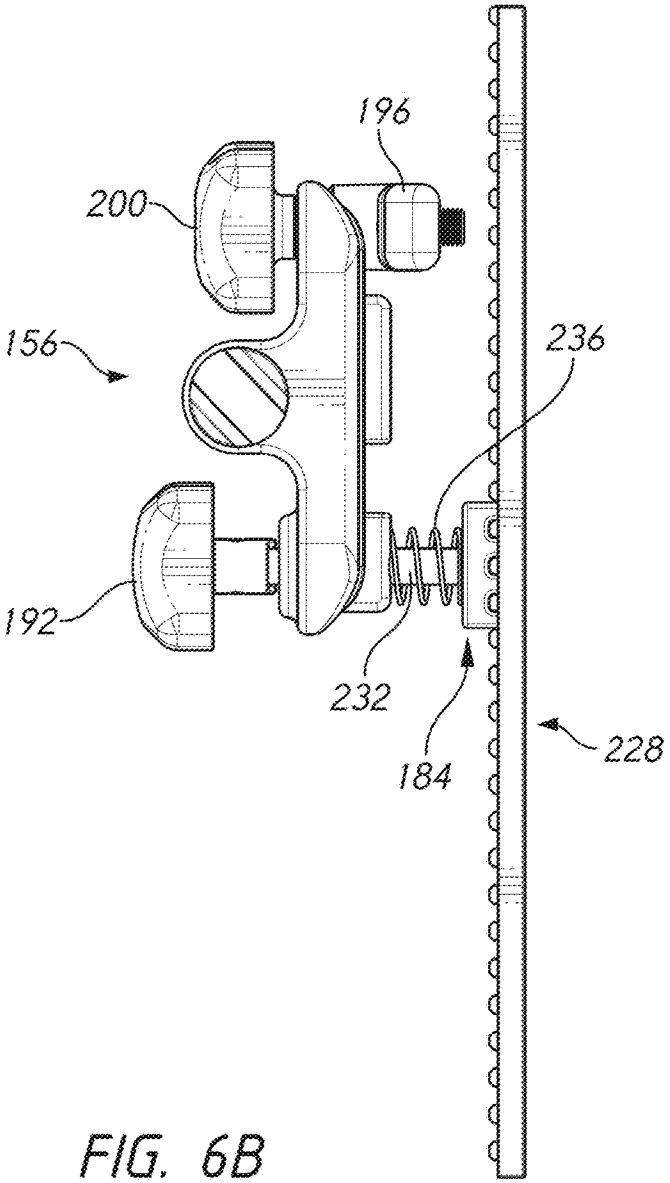
FIG. 6B is a side view of the rack of FIG. 4 and the support assembly of FIG. 3A, with the upright pole removed, the pawl of the support assembly in an engaged state with the rack.
Figure 6A:
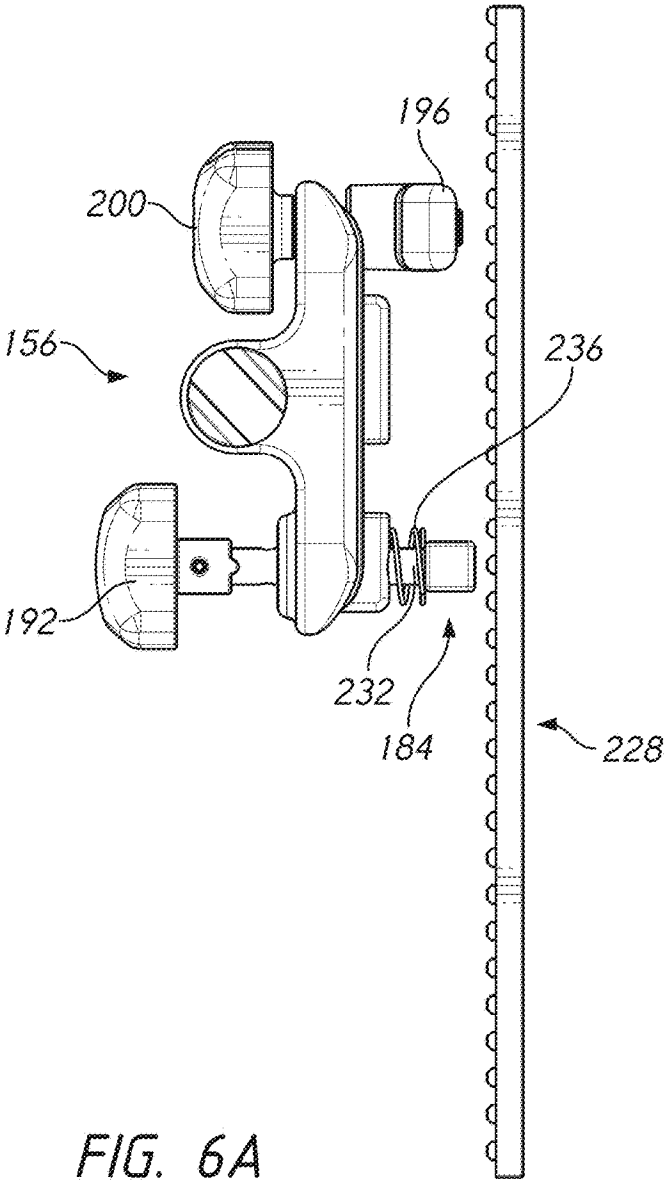
FIG. 6A is a side view of the rack of FIG. 4 and the support assembly of FIG. 3A, with the upright pole removed, the pawl of the support assembly and the clamping block of the support assembly each in a disengaged state.
Figure 6C:
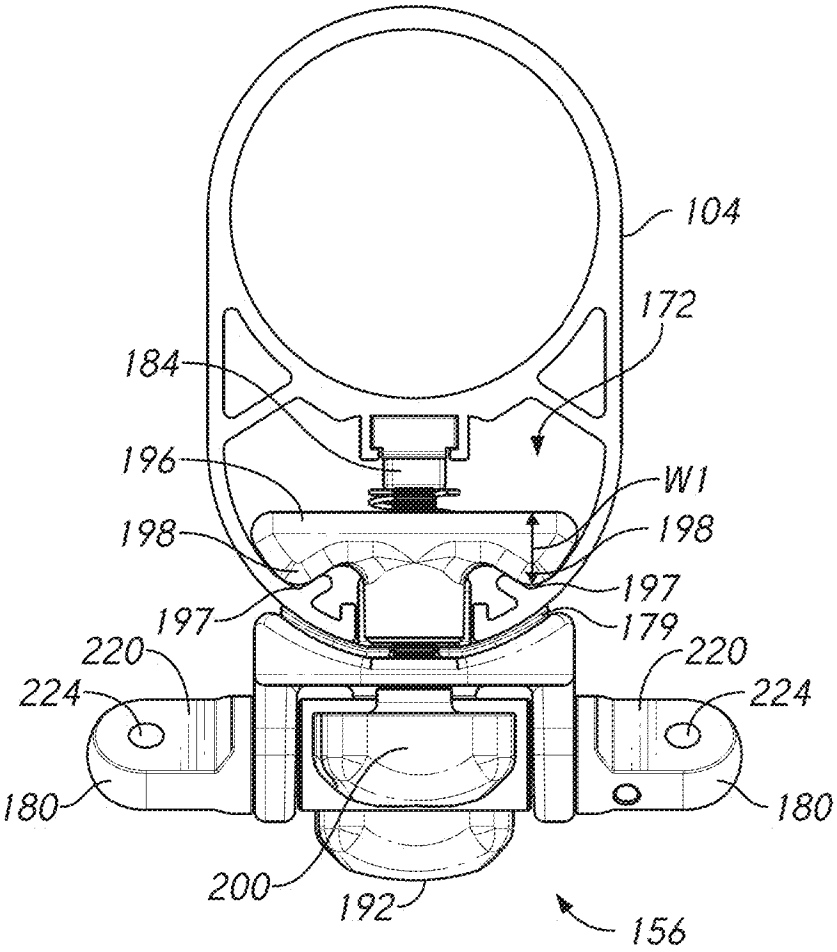
FIG. 6C is a top view of the support assembly of FIG. 3A coupled to the upright pole, with the clamping block of the support assembly in an engaged state with the upright pole.
Figure 7:
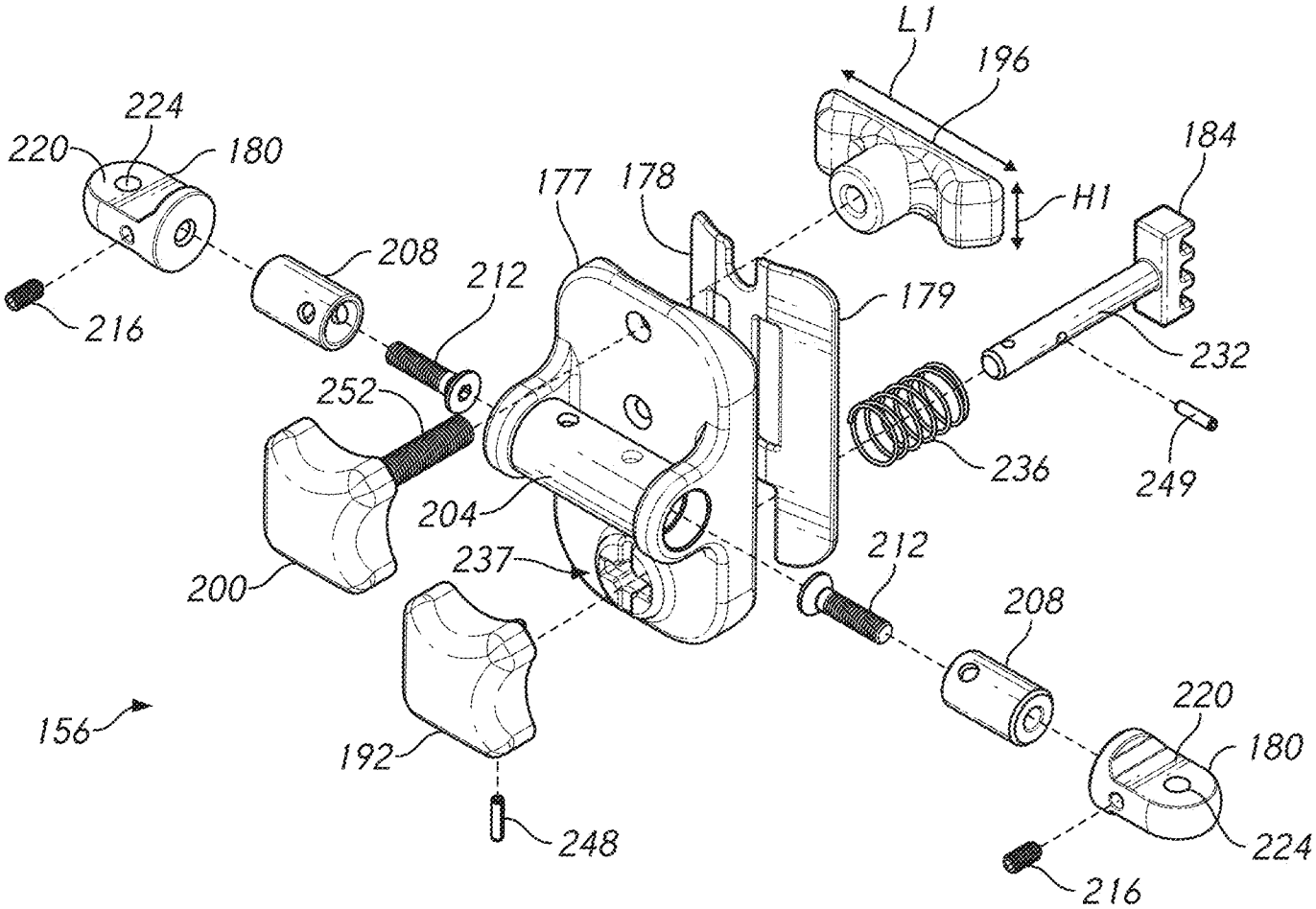
FIG. 7 is an exploded view of the support assembly of FIG. 3A.

FIGS. 3A-7 illustrate additional details of an example embodiment of a support assembly, such as the support assembly 156 of the stabilizing assembly 116 of FIGS. 1 and 2. FIGS. 3A-3F illustrate the support assembly 156 slidably coupled to a portion of the upright pole 104. FIG. 4 illustrates more detail of the upright pole 104 without the support assembly 156 coupled thereto. FIG. 5 illustrates a side view of the support assembly 156 removed from the upright pole 104. FIGS. 6A-6C illustrate engaged and disengaged configurations of the support assembly 156 with respect to portions of the upright pole 104. FIG. 7 illustrates an exploded view of the support assembly 156.

With reference to FIGS. 3A and 3B, the support assembly 156 can include a base member 176 and one or more strut seats or rotary seats 180. The strut seats 180 can desirably be pivotally coupled to ends of the struts (for example, ends of the two struts 160 shown in FIG. 2). The strut seats 180 can also desirably be pivotally coupled to the base member 176. The base member 176 can desirably be slidably coupled to the upright pole 104, such that the support assembly 156 can be repositioned along a longitudinal axis of the upright pole 104.

Setting up a cantilever umbrella, adding the stabilizing assembly to the cantilever umbrella, and/or adjusting the support assembly 156 with respect to the upright pole 104 could be an awkward or somewhat difficult operation, particularly when performed by a single person. To reduce the complexity and/or to make it easier to install and/or adjust, such as by a single person, the support assembly 156 includes a number of features that help in positioning and locking the support assembly 156 in place with respect to the upright pole 104. For example, initial or rough positioning of the support assembly 156 with respect to upright pole 104 can be accomplished by pulling out positioning knob 192, moving the support assembly 156 up or down to the desired position, and then releasing positioning knob 192. This can cause a pawl to engage a rack and maintain the support assembly 156 in that position (as described in greater detail below). If minor adjustments are needed to the position of the support assembly 156, this process can be repeated, by pulling out the positioning knob 192, adjusting the position of the support assembly 156, and again releasing the positioning knob 192. Once the final desired position of the support assembly 156 is attained, clamping knob 200 can be rotated, which will desirably lock the support assembly 156 in place with respect to the upright pole 104 (as described in greater detail below).

As shown in FIG. 5, the support assembly 156 can include a pawl or tooth pin 184 comprising one or more teeth 188. The pawl 184 can be biased toward a rack 228 (see FIG. 4) within the upright pole 104. In some embodiments, the pawl 184 can be spring-loaded. The support assembly 156 can include a positioning knob 192 that can be operable to overcome the biasing of the pawl 184 (see, for example, the description below associated with FIGS. 6A and 6B). The pawl 184 may alternatively be referred to as a retention member, a toothed member, and/or the like. In some embodiments, the pawl 184 may be configured to operate as a one-way clutch, similar to how a pawl in a ratchet operates. For example, the pawl 184 and/or the rack 228 it engages may be designed such that the support assembly 156 can be raised without manually pulling out on the positioning knob 192, but that manually pulling out on the positioning knob 192 is required to lower the support assembly 156. Such functionality is not required, however, and the version illustrated in FIGS. 4 and 5 does not include such functionality.

With continued reference to FIG. 5, the support assembly 156 can also include a clamping block 196 and a clamping knob 200. Desirably, rotation of the clamping knob 200 will cause the clamping block 196 to move toward or away from the base member 176, in order to lock or release the base member 176 with respect to the upright pole 104. Further details of such operation are described below, with reference to FIGS. 6A-6C. With reference to FIG. 3C, the clamping block 196 can have a planar or flat surface that faces away from the clamping knob 200 and non-planar surfaces 198 that face toward the clamping knob 200 (and toward non-planar surfaces 197 of the upright pole 104). The functionality of the non-planar surfaces 198 are described below, with reference to FIG. 6C. The clamping block 196 can have side surfaces 199 (labeled in FIG. 3D) connecting the flat surface and non-planar surfaces. The side surfaces 199 can generally correspond to or complement a curvature of the upright pole 104. The clamping block 196 can have a length L1 that exceeds a height H1 (labeled in FIG. 7). The clamping block 196 can have a width W1 (labeled in FIG. 6C) that varies along the length L1 of the clamping block 196. It should be noted that the above-provided description of the general shape of the clamping block 196 is merely one example of how the clamping block 196 can be structured, and the clamping block 196 may take various other shapes or forms, as long as the clamping block 196 can perform its intended function (e.g., selectively locking or unlocking movement of the support assembly 156 with respect to the upright pole 104).

With reference to FIG. 7, the base member 176 can comprise a first portion or fixing block 177 and a second portion or gasket 178. In some embodiments, the first portion 177 and the second portion 178 can form a single integral or unitary part, but in some embodiments they are not a single integral or unitary part. In some embodiments, the second portion 178 is a gasket, a piece of rubber, and/or the like, which can, for example, protect the interface between the first portion 177 and the outer surface of the upright pole 104, generate friction between the first portion 177 and the outer surface of the upright pole 104, create a water resistant or waterproof seal between the first portion 177 and the outer surface of the upright pole 104, and/or the like. With reference to FIG. 3C, a pole facing side 179 of the base member 176 can be contoured to rest against the upright pole 104. The pole facing side 179 of the base member 176 can have a radius of curvature that corresponds to or complements the radius of curvature of the upright pole 104. The corresponding features of the pole facing side 179 of the base member 176 and the upright pole 104 can allow the support assembly 156 to easily slide up and down the height the of the upright pole 104 when the clamping block 196 is not pulled against the interior of the upright pole 104 (as shown in FIG. 3C), but can also help to lock the support assembly 156 in place with respect to the upright pole 104 when the clamping block 196 is pulled forced against the interior of the upright pole 104 (as shown in FIG. 6C).

Returning to FIGS. 3A and 3B, the one or more strut seats 180 can be pivotally coupled to or formed as a part of the base member 176. In this embodiment, each strut seat 180 is pivotally coupled to the base member 176, providing one rotational degree of freedom, and an end of a struts 160 is pivotally coupled to the strut seat 180, providing an additional rotational degree of freedom. The disclosure is not limited to this specific embodiment, however, and other mechanisms of movably coupling the ends of the struts 160 to the base member 176 may be used. For example, the strut seat 180 may alternatively comprise a ball joint, or any other type of joint or combination of joints capable of pivotably connecting the strut 160 to the base member 176.

With reference to FIG. 7, in some embodiments, the base member 176 can include a connecting sleeve 204 to assist in pivotally coupling the one or more strut seats 180 to the base member 176. The connecting sleeve 204 can extend generally perpendicular to the longitudinal axis of the upright pole 104. The connecting sleeve 204 can extend along the width of the base member 176. A length of the connecting sleeve 204 can be equal to, greater than, or less than a width of the base member 176. Each strut seat 180 can be coupled to the connecting sleeve 204 via a rotary joint 208. The rotary joint 208 can be coupled to the connecting sleeve 204 via a screw 212. The screw 212 can extend into the rotary joint 208 along the central axis of the rotary joint 208 to allow the rotary joint 208 and strut seat 180 to have 360 degrees of rotation. A screw 216 can be used to couple the strut seat 180 to the rotary joint 208.

Each strut seat 180 can include two opposing generally planar surfaces 220. An end of the strut 160 can be coupled to the generally planar surfaces 220 of the strut seat the strut seat 180 as disclosed herein. Each strut seat 180 can include a through hole 224 that extends from the first generally surface 220 to the second generally planar surfaces 220. The through hole 224 can assist in coupling the end of the strut 160 to the strut seat 180 as disclosed herein.

With reference to FIGS. 4, 5, 6A, and 6B, the pawl 184 can be spring-loaded to engage a rack 228 of the upright pole 104. The pawl 184 can include a shaft 232 that extends from a back surface of the pawl 184 in a direction opposite the one or more teeth, protruding member, steps, and/or the like 188. A biasing member (e.g., a spring) 236 can be disposed on the shaft 232. The biasing member 236 can bias the pawl 184 toward the rack 228 to engage the one or more teeth 188 with the rack 228. The rack 228 can include a plurality of steps, teeth, protruding members, and/or the like 240 separated by recessed areas or open spaces 244. When the pawl is engaged with the rack 228, the one or more teeth 188 can be positioned at least partially within the recessed areas 224 and/or rest upon or between the steps 240, as is shown in FIG. 6B. The rack 228 can be engaged and/or used by both the integrated deployment mechanism 155 (e.g., by the pinion gear or pawl of the integrated deployment mechanism 155 discussed above) and the pawl 184 of the support assembly 156. The engagement and/or use by both the integrated deployment mechanism 155 and the support assembly 156 can be advantageous in that it can reduce the weight of the umbrella assembly 100, reduce the cost to manufacture the umbrella assembly 100, and increase the ease of manufacturing the umbrella assembly 100, as compared to an alternative design that uses separate racks (or other features) for the integrated deployment mechanism 155 and support assembly 156.

The shaft 232 can at least partially extend through the base member 176 such that an end opposite the pawl 184 can be coupled to the positioning knob 192. The positioning knob 192 can be coupled to the shaft 232 via a pin 248 that extends through an opening in the shaft 232 (see FIG. 7). The positioning knob 192 can be positioned on the non-pole facing side of the base member 176 while the pawl 184 can be positioned on the pole facing side 179 of the base member 176. The positioning knob 192 can be pulled away from the upright pole 104, which can pull the pawl 184 away from the rack 228, disengaging the one or more teeth 188 from the rack 228, as is shown in FIG. 6A. FIG. 6A also shows that the pawl 184 (and knob 192) can desirably be rotatable about a longitudinal axis of the shaft 232, such as to achieve the functionality described below with reference to FIGS. 3E and 3F.

With reference to FIGS. 5 and 6A-6C, the clamping knob 200 can include or be attached to a shaft 252, such as a threaded shaft, that can couple the clamping knob 200 to the clamping block 196. In some embodiments, the shaft 252 can be threaded. The clamping knob 200 can be positioned on the non-pole facing side of the base member 176 while the clamping block 196 can be positioned on the pole facing side 179 of the base member 176. The shaft 252 can extend through an opening in the base member 176 to couple the clamping knob 200 and the clamping block 196 on opposite sides of the base member 176. Desirably, the knob 200 is fixed to the threaded shaft 252, and the clamping block 196 includes an internal thread that engages the external thread of the threaded shaft 252. Accordingly, rotation of the clamping knob 200 with respect to the base member 176 and clamping block 196 can cause the clamping block 196 to move toward or away from the knob 200.

With reference to FIG. 6C, the clamping block 196 is shown in an engaged state (e.g., engaged with the inner surfaces 197 of the upright pole 104). The rotation of the clamping knob 200 (and thus the threaded shaft 252) has moved the clamping block 196 toward at least one inner surface 197 of the upright pole 104. When in the engaged state, surfaces 198 of the clamping block 196 can engage or come into contact with the inner surface(s) 197 of the upright pole 104. The shape or curvature of the inner surfaces 197 of the upright pole 104 can complement or correspond to the shape or curvature of the surfaces 198 of the clamping block 196. For example, surfaces 197 can be concave and surfaces 198 can be convex (although other shapes, including without any curvature, are possible). The engagement of surfaces 198 with surfaces 197, and of gasket 178 with the exterior surface of the upright pole 104, desirably generates sufficient static friction to hold or lock the support assembly 156 in position with respect to the upright pole 104. The holding or locking force is desirably sufficient to keep the support assembly 156 from moving with respect to the upright pole 104 even when relatively large forces are applied to the support assembly by the struts 160 in response to significant wind forces acting on the canopy 140.

When in a disengaged state (such as is shown in FIGS. 3C and 3D), the clamping block 196 can also desirably be rotated about 90 degrees such that the clamping block 196 can be removed from the support assembly 156 through channel 168 (see FIG. 3A), or installed onto the upright pole 104 through channel 168, without having to disassemble the clamping block 196 from the support assembly 156. This feature is not required, but can be desirable, such as to make the stabilizing assembly 116 easier to install onto and/or remove from the umbrella. When rotated for removal or installation, the clamping block 196 can have a height H1 (as labeled in FIG. 5) that is less than a width W2 of the channel 168 (shown in FIG. 3B) of the upright pole 104.

Returning to FIGS. 3A & 3B, the support assembly 156 can be at least partially positioned through a channel 168 into an internal cavity 172 of the upright pole 104. For example, at least the clamping member 196, pawl 184, and protrusion, guide, and/or the like 173 (shown in FIGS. 3D and 5) can be positioned within the channel 168 and/or the cavity 172. The protrusion 173 can be sized to fit within the channel 168 and guide the support assembly 156 as it slides up and down the upright pole 104. The protrusion 173 can assist in preventing or limiting rotation of the support assembly 156 relative to the upright pole 104 and/or preventing or limiting side-to-side movement of the support assembly 156 relative to the upright pole 104. The support assembly 156 can be slidable with respect to the internal cavity 172 in the longitudinal direction. The slidability of the support assembly 156 allows for the positioning or height of the support assembly 156 to be adjusted.

FIGS. 6A and 6B are side views of the rack 228 and support assembly 156 with the upright pole 104 removed for illustrative purposes. FIG. 6C is a top view, without the upright pole 104 removed. In FIG. 6A, the pawl 184 of the support assembly 156 and the clamping block 196 of the support assembly 156 are each in a disengaged state, while in FIGS. 6B and 6C, the pawl 184 and the clamping block 196 are each in an engaged state. For example, the pawl 184 is engaged with the rack 228 (FIG. 6B), and the clamping block 196 is engaged with surfaces 197 (FIG. 6C) within the internal cavity 172 of the upright pole 104.

The support assembly 156 can be in a completely disengaged state when both the pawl 184 is not engaged with the rack 228 and the clamping block 196 is not engaged with the surfaces 197 of the upright pole 104. The clamping block 196 and the pawl 184 can be positioned such that there is a space or gap between both the clamping block 196 and the surfaces 197 of the upright pole 104 as well as the pawl 184 and the rack 228. The support assembly 156 can be in a partially disengaged and/or partially engaged state when the pawl 184 is in contact with the rack 228, but the clamping block 196 is not engaged with the surfaces 197 of the upright pole 104, or vice versa. The support assembly 156 can be in a completely engaged state when both the clamping block 196 is engaged with the surfaces 197 of the upright pole 104, and the pawl 184 is engaged with the rack 228. Such features can be desirable, because, for example, the pawl 184 can be used to relatively easily limit or restrict the movement of the support assembly 156 with respect to the upright pole while the stabilizing assembly 116 is being setup, and the clamping block 196 can then be used to more firmly or rigidly lock the support assembly 156 in place with respect to the upright pole 104 once the final position of the support assembly 156 is determined. Stated another way, the positioning knob 192 can be used to relatively easily reposition the support assembly 156 while setting up the stabilizing assembly 116 (with the pawl 184 being used to limit or restrict movement of the support assembly 156 with respect to the upright pole 104, but not necessarily being required to firmly or rigidly hold the support assembly 156 in place with respect to the upright pole 104), and the clamping knob 200 can be used to firmly or rigidly lock the support assembly 156 in place once the most desirable position of the support assembly 156 is determined.

The clamping block 196 can be transitioned between an engaged state and a disengaged state by rotating the clamping knob 200. Rotation of the clamping knob 200 in a first direction can move the clamping block 196 closer to the rack 228 such that the surfaces 198 of the clamping block 196 disengage the surfaces 197 of the upright pole 104. The clamping block 196 can be rotated in a second direction, opposite the first direction, to move the clamping block 196 away from the rack 228, toward the surfaces 197 of the upright pole 104, which transitions the clamping block 196 to an engaged state. The clamping block 196 being in an engaged state can assist in fixing the positioning of the support assembly 156.

As described herein, the pawl 184 can be in an engaged state when the one or more teeth 188 are engaged with the rack 228. When in an engaged state, the pawl 184 can limit movement of the support assembly 156 with respect to the upright pole 104. The pawl 184 can be transitioned to a disengaged state by pulling the positioning knob 192 away from the upright pole 104. When in the disengaged state, the pawl 184 does not limit movement of the support assembly 156 with respect to the upright pole 104. The pulling of the positioning knob 192 can remove the one or more teeth 188 from engagement with the rack 228. Once the pawl 184 is removed from engagement with the rack 228, the positioning knob 192 can be rotated to transition the pawl 184 from a vertical orientation (as shown in FIG. 6B) to a horizontal orientation (as shown in FIG. 6A). This can reduce the risk that the one or more teeth can engage the rack 228 while the pawl is in a disengaged state (and another technique for keeping the teeth from engaging the rack is described below). The pawl 184 can be transitioned back to an engaged state by rotating the positioning knob 192 in the opposite direction to return to the pawl to the vertical orientation and allowing the biasing member 236 to engage the one or more teeth 188 with the rack 228.

In some embodiments, the base member 176 can include an opening 237 as shown in FIGS. 3E, 3F and 7. In some embodiments, the opening 237 can be shaped such that, when the shaft 232 is in a first rotational orientation (e.g., the orientation shown in FIG. 3E), the opening 237 can allow a pin 249 positioned in the shaft 232 of the pawl 184 to pass therethrough. For example, as the positioning knob 192 is pulled away from the upright pole 104, the shaft 232 and pin 249 can pass through the opening 237. The first rotational orientation is shown in FIG. 3E. The opening 237 can also desirably be shaped such that, when the shaft 232 is in a second rotational orientation (e.g., the orientation shown in FIG. 3F, which is 90 degrees from the orientation of FIG. 3E), the pin 249 cannot pass therethrough. For example, the base member 176 of the support assembly 156 can include one or more blocking portions 238 that engages the pin 249 to limit movement of the one or more teeth 188 of the pawl 184 toward the rack 228 with the positioning knob 192 in the second rotational orientation. The second rotational orientation is shown in FIG. 3F. In some embodiments, the blocking portion can be a groove, detent, recessed area, or any portion of the base member 176 that does not have an opening. The pin 249 can come into contact with and/or rest at least partially within the one or more blocking portions 238, for example, as shown in FIG. 3F. The blocking portion desirably can at least partially resist the shaft 232 from returning back to the first rotational orientation, to help avoid unintentional engagement of the pawl.

Example Rib Fixation Assembly

Figure 8B:
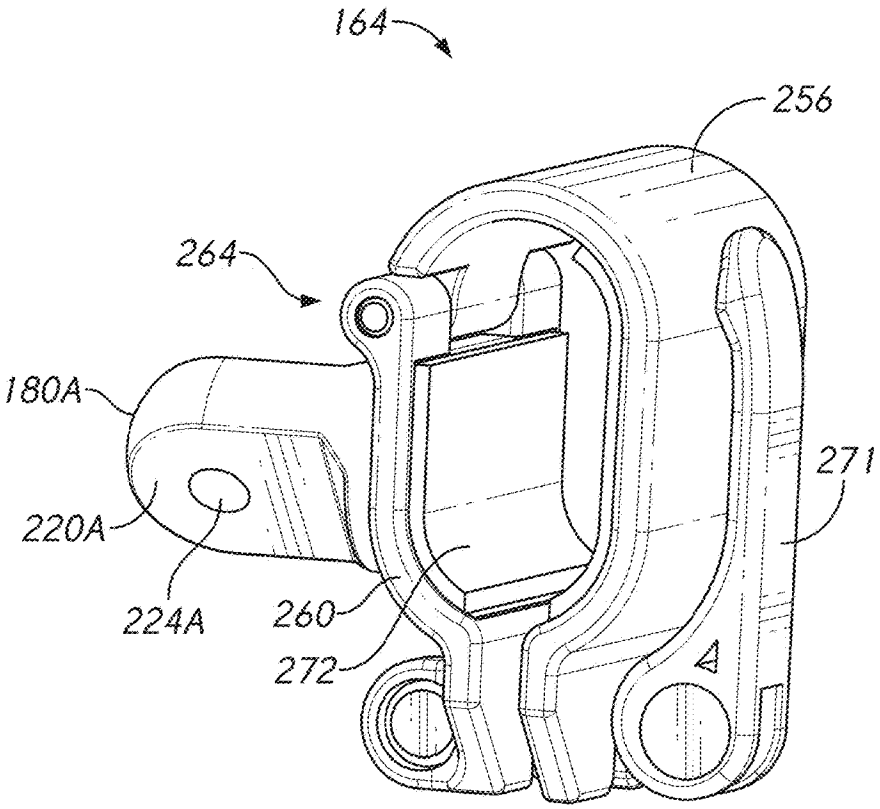
FIG. 8B is another perspective view of the rib fixation assembly of FIG. 8A.
Figure 8A:
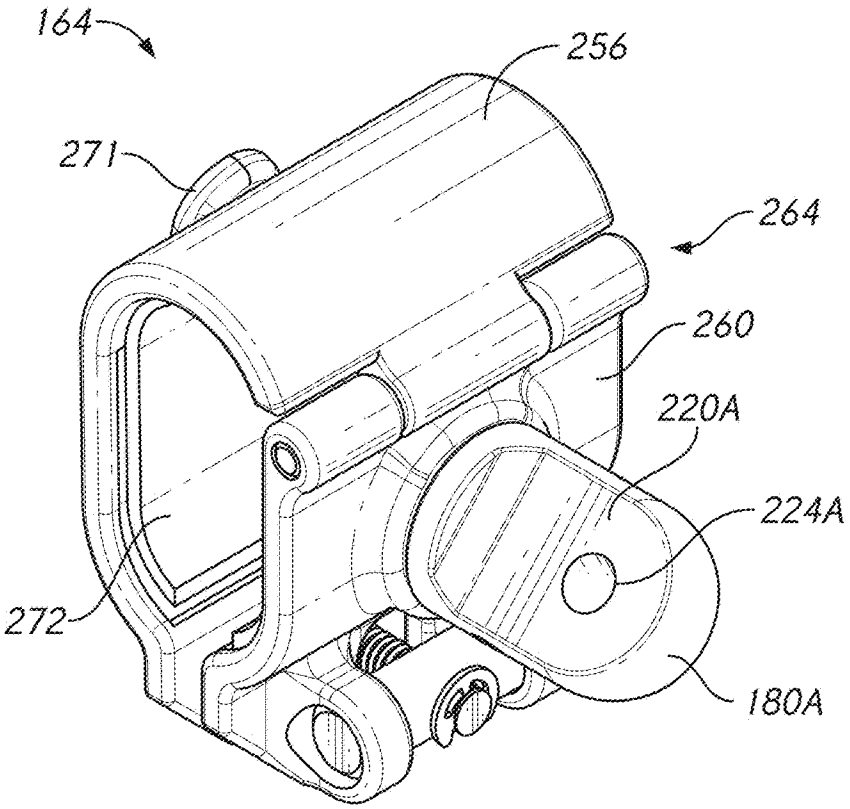
FIG. 8A is a perspective view of a rib fixation assembly of the stabilizing assembly of FIG. 1.
Figure 8D:
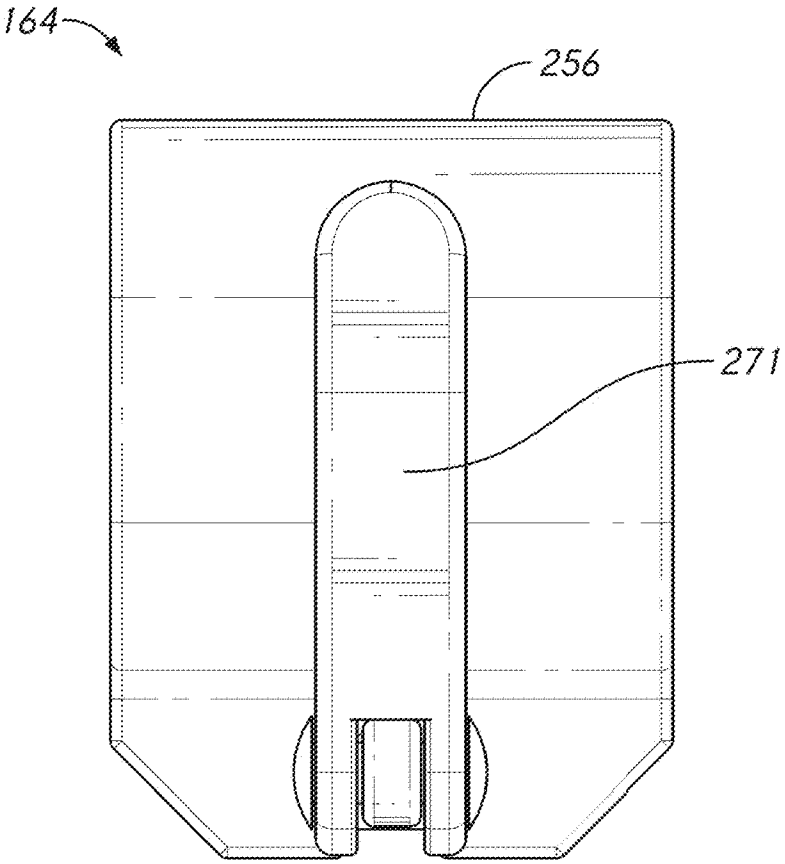
FIGS. 8C and 8D are front and back views, respectively, of the rib fixation assembly of FIG. 8A.
Figure 8C:
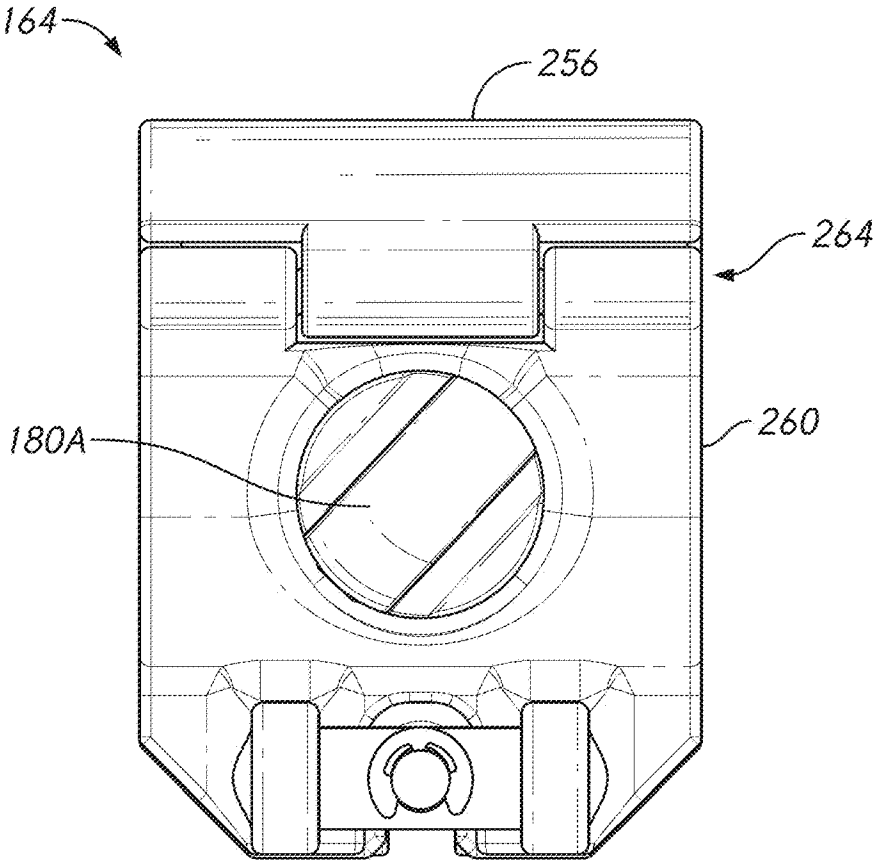
Figure 8F:
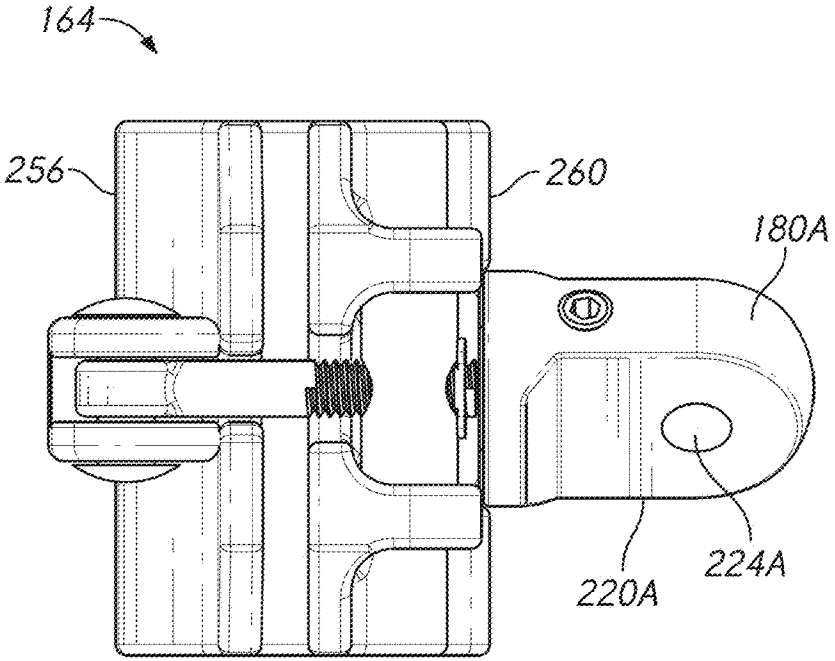
FIG. 8F is a bottom view of the rib fixation assembly of FIG. 8A.
Figure 8E:
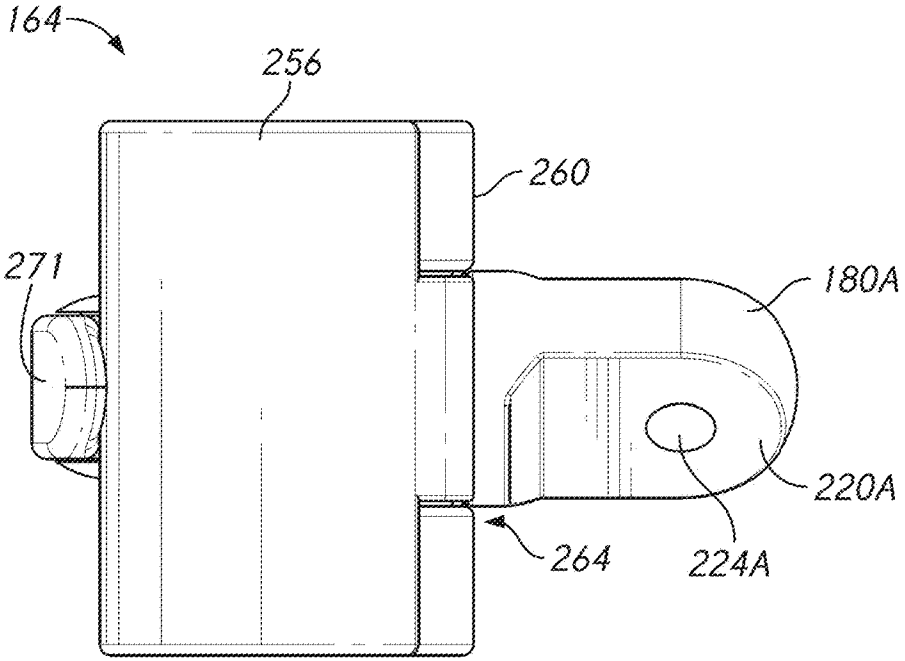
FIG. 8E is a top view of the rib fixation assembly of FIG. 8A.
Figure 8H:
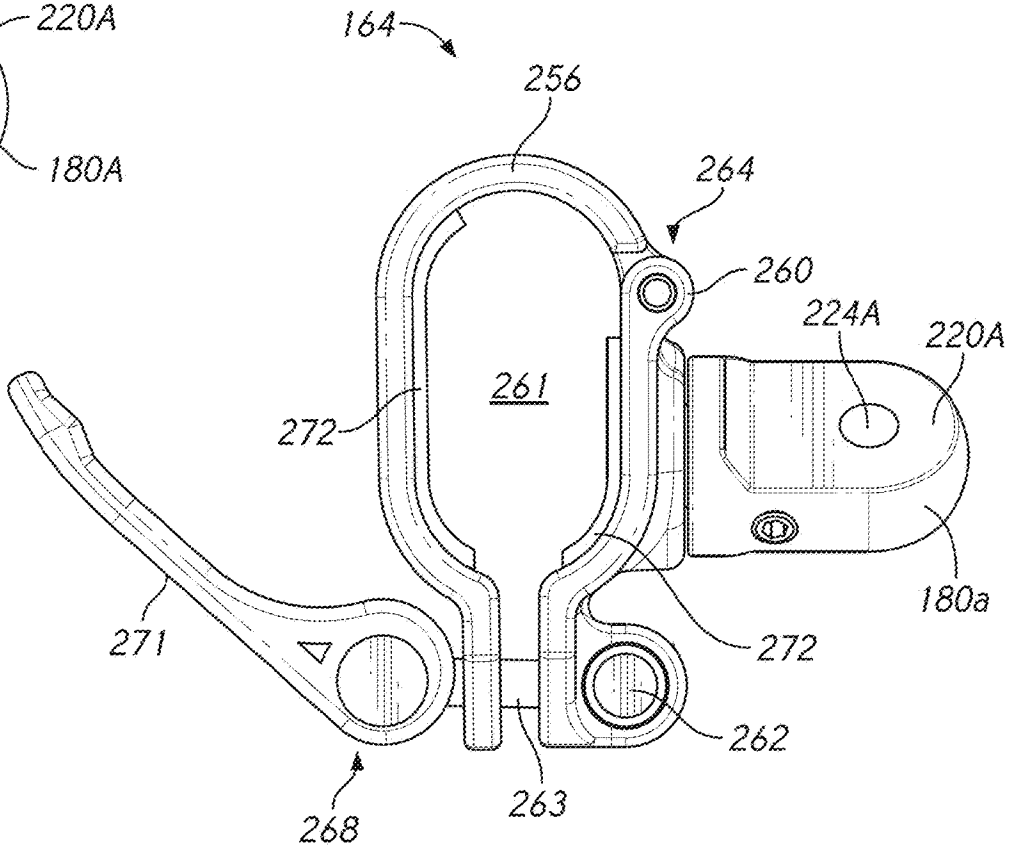
FIG. 8H is a side view of the rib fixation assembly of FIG. 8A, with the clamping member in a partially disengaged position.
Figure 8G:
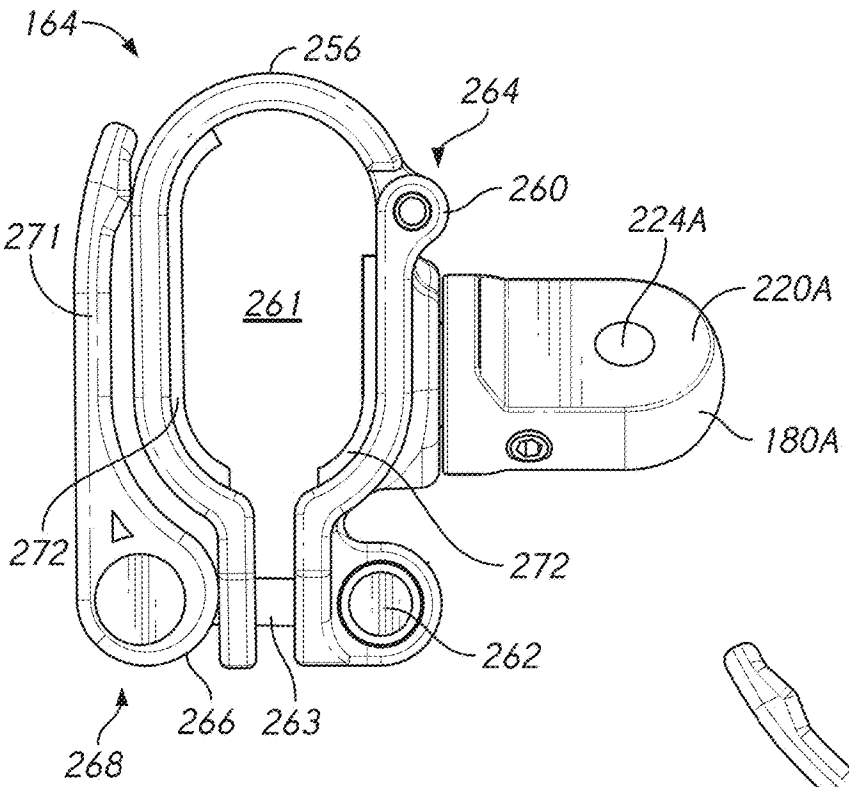
FIG. 8G is a side view of the rib fixation assembly of FIG. 8A, with a clamping member in an engaged position.
Figure 81:
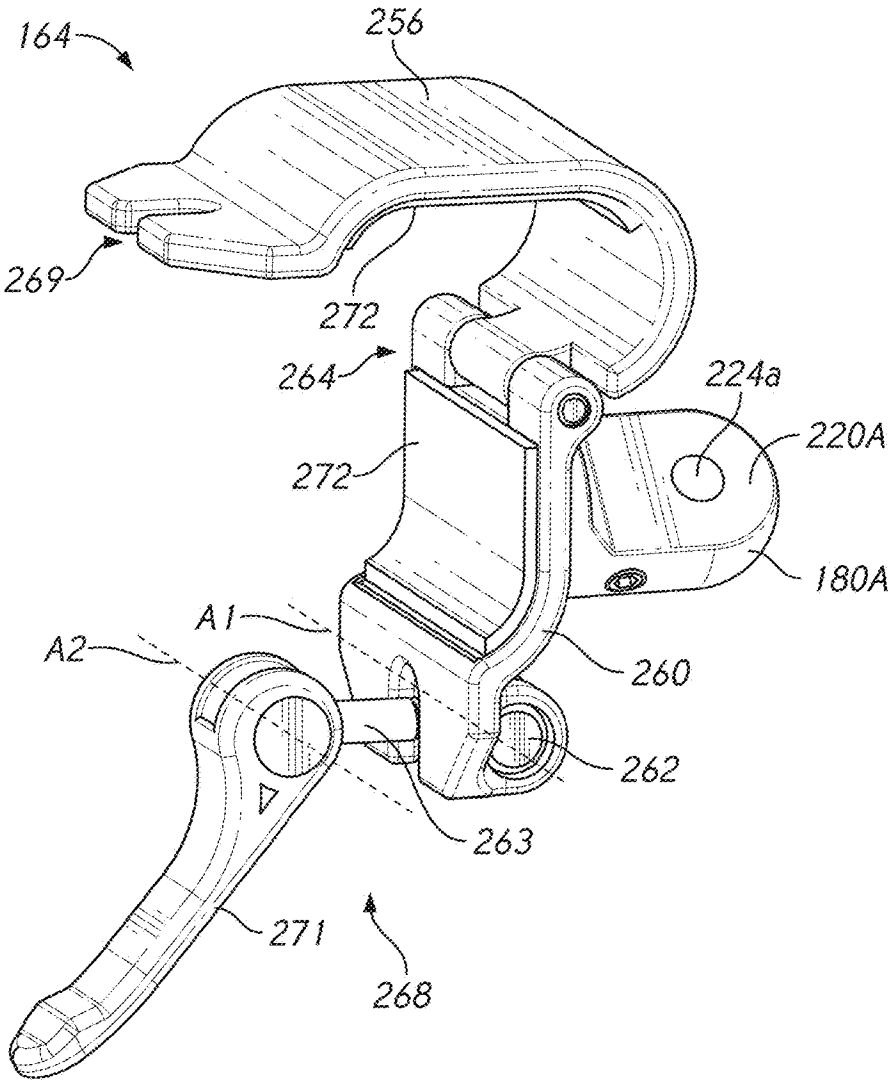
Figure 9:
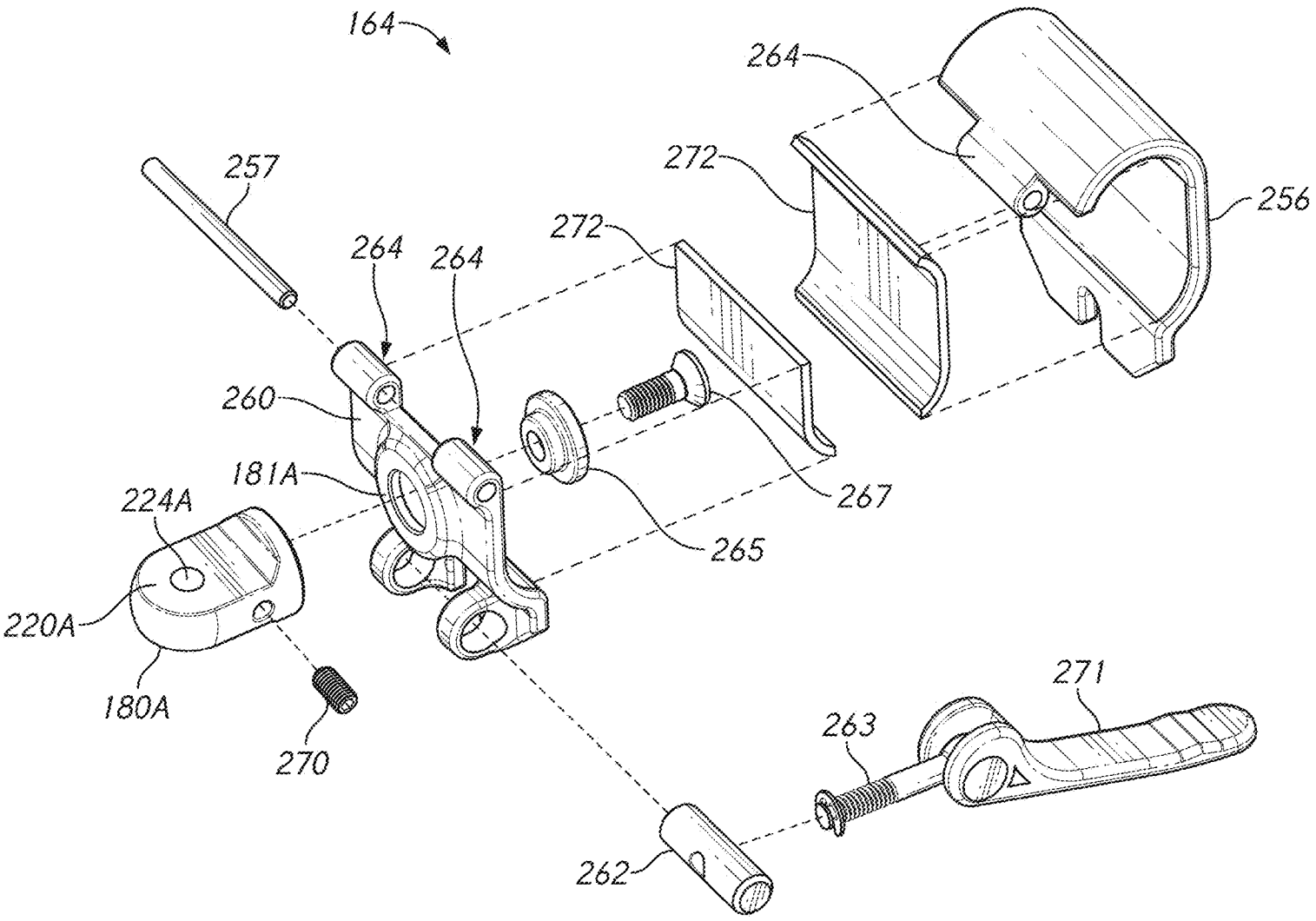
FIG. 9 is an exploded view of the rib fixation assembly of FIG. 8A.

FIGS. 8A-8I illustrate an example embodiment of the rib fixation assembly 164. FIG. 9 illustrates an exploded view of the rib fixation assembly 164. With reference to FIGS. 8A and 8B, the rib fixation assembly 164 can include a first member or base plate 256 and a second member or base plate 260. The first member 256 can at least partially wrap around the rib 132 (e.g., the rib 132 of FIG. 1). The second member 260 can also at least partially wrap around the rib 132. The second member 260 can be pivotally coupled to first member 256 at a joint 264. A pin 257 (see FIG. 9) can be used to couple the first member 256 to the second member 260 at the joint 264. The first member 256 can be pivotable with respect to the second member 260 between an open and closed configuration as disclosed herein. For example, FIG. 8I shows the open configuration, and FIG. 8B shows the closed configuration.

The rib fixation assembly 164 can include a clamp mechanism 268. In some embodiments, the clamp mechanism 268 can comprise a quick release buckle 271. The clamp mechanism 268 can be secured to the second member 260 via a shaft 263, which forms a pivoting or rotary joint that pivots about axis A1 (see FIG. 8I). The shaft 263 of the clamp mechanism 268 can be secured to the rotary joint 262 via a mechanical fastener, for example, a screw or pin, and in some embodiments can attach directly to the rotary joint 262 without additional fasteners. For example, the shaft 263 can be at least partially threaded to assist in securing the shaft 263 to the rotary joint 262. The rotary joint 262 can allow for a controlled pivoting of the quick release buckle 271 and shaft 263 about axis A1, in order to engage or disengage the first member 256.

The quick release buckle 271 of the clamp mechanism 268 can be pivotable with respect to the shaft 263 between an open and a closed position or configuration. For example, the quick release buckle 271 can rotate around the axis A2 (see FIG. 8I). Pivoting the quick release buck 271 can enable the clamp mechanism 268 to also be changed between an open and a closed position or configuration. FIG. 8G illustrates the quick release buckle 271 and the clamp mechanism 268 in their closed configurations (e.g., a configuration in which the rib fixation assembly 164 can be clamped to a rib of the umbrella canopy), FIG. 8H illustrates the quick release buckle 271 and clamping mechanism 268 transitioning to their open configurations, and FIG. 8I illustrates the quick release buckle 271 in its open configuration. When the quick release buckle 271 is in its open configuration (as shown in FIG. 8I), the shaft 263 may be rotated downward (e.g., rotated counterclockwise about axis A1, as oriented in FIG. 8I) to complete movement of the clamp mechanism 268 to its open configuration. With reference to FIG. 8G, the quick release buckle 271 can include a cam surface 266. When in its closed configuration the cam surface 266 of the quick release buckle 271 can engage an outer surface of the first member 256, for example, as shown in FIG. 8G. When in its closed configuration, the clamp mechanism 268 can maintain the rib fixation assembly 164 in a closed configuration (e.g., clamping the rib fixation assembly 164 about an umbrella rib).

In the closed configuration, the first member 256 and the second member 260 can form a generally enclosed space 261. A rib 132 of the umbrella assembly 100 can be disposed within the enclosed space 261 such that the rib fixation assembly 164 is secured to the rib 132. Desirably, the rib fixation assembly also includes pads 272, which may comprise an elastomer, foam, and/or the like, and may help to affix the rib fixation assembly 164 to the rib 132 and/or to prevent damage to the rib 132. When the clamping mechanism is in the closed position or configuration and the rib fixation assembly 164 is positioned on the rib 132, the positioning of the rib fixation assembly 164 can be fixed. When in the closed position or configuration, a portion of the shaft 263 of the clamping mechanism 268 can be received within a recess 269 (visible in FIG. 8I) of the first member 256. The recess 269 can at least partially surround the shaft 263. This can help, for example, to keep the first and second members 256, 260 in proper alignment in the closed position or configuration.

The clamp mechanism 268 can be transferred from the closed position or configuration to the open position or configuration to remove the rib fixation assembly 164 from the rib 132, adjust the positioning of the rib fixation assembly 164 along the length of the rib 132, or position the rib fixation assembly 164 on the rib 132. Desirably, the rib fixation assembly 164 can be installed onto, and removed from, the rib 132 along a direction transverse to a longitudinal axis of the rib. This can help to, for example, enable the rib fixation assembly 164 to be installed or removed without having to disassemble the umbrella.

FIG. 8I illustrates the rib fixation assembly 164 in an open configuration. To transition the clamp mechanism 268 to the open position, the clamp mechanism 268 can be removed from the recess 269 and pivoted away from the first member 256. Once the clamp mechanism 268 is pivoted away from the first member 256, the first member 256 can then be pivoted away from the second member 260 to create an opening. The rib fixation assembly 164 can then be removed from the rib 132, positioned on the rib 132, or adjusted along the length of the rib 132. If the rib fixation assembly 164 is being positioned on the rib 132 or adjusted along the length of the rib 132, the rib fixation assembly 164 can be secured (or resecured) to the rib by pivoting the clamp mechanism 268 to a closed position. In some embodiments, the clamping mechanism 268 can be opened a known amount to loosen the grip the rib fixation assembly 164 has on the rib 132 such that the rib fixation assembly 164 can be slid along the length of the rib 132 without having to fully open or remove the rib fixation assembly 164 to adjust the positioning of the rib fixation assembly 164.

The rib fixation assembly 164 can include a strut seat or rotary seat 180A. Some of the features of the strut seat 180A are similar to features of the strut seat 180 in FIGS. 3A-7. Thus, reference numerals used to designate the various components of the strut seat 180A are identical to those used for identifying the corresponding components of the strut seat 180 in FIGS. 3A-7, except that a "A" has been added to the numerical identifier. Therefore, the structure and description for the various features of the strut seat 180 and how it operates in FIGS. 3A-7 are understood to also apply to the corresponding features of the strut seat 180A in FIGS. 8A-9, except as described below. Though the features below are described in connection with the strut seat 180A, the features also apply to all strut seats, such as strut seat 180 disclosed herein.

The strut seat 180A can be rotatably coupled to the second member 260. The strut seat 180A can be coupled to a circular step 181A of the second member 260. The strut seat 180A can be coupled to a first side of the second member 260. A securing member or base 265 can be coupled to a second side, opposite the first side of the second member 260. A mechanical fastener 267, such as a pin or screw, can be used to connect the strut seat 180A and the securing member 265. The mechanical fastener 267 can extend from the first side of the second member 260 to the second side of the second member 260. An additional pin or threaded screw 270 can be inserted into a threaded hole of the strut seat 180A generally perpendicular to the mechanical fastener 267 to further secure the strut seat 180A to the second member 260. The strut seat 180A can extend outward from the second member 260 generally perpendicular to the longitudinal axis of the rib fixation assembly 164. An end of the strut 160, opposite the end that is coupled to the strut seat 180 of the support assembly 156, can be coupled to the generally planar surfaces 220A the strut seat 180A as disclosed herein.

In some embodiments, the rib fixation assembly 164 can include one or more pads 272. The pads 272 can be positioned on an inner rib facing surface of the first member 256 and/or the second member 260. The one or more pads 272 can cover the entire inner rib facing surface or a portion of the inner rib facing surface. The one or more pads 272 can correspond to the contour of the rib facing surface of the member 256, 260 that they are disposed on. More than one pad 272 can be positioned on either of the first member 256 or second member 260. The pads 272 can be made of a material that can prevent damage to the rib 132 that the rib fixation assembly 164 is positioned on, for example, the pads 272 can comprise a silicone or foam material.

Example Strut

Figure 10A:
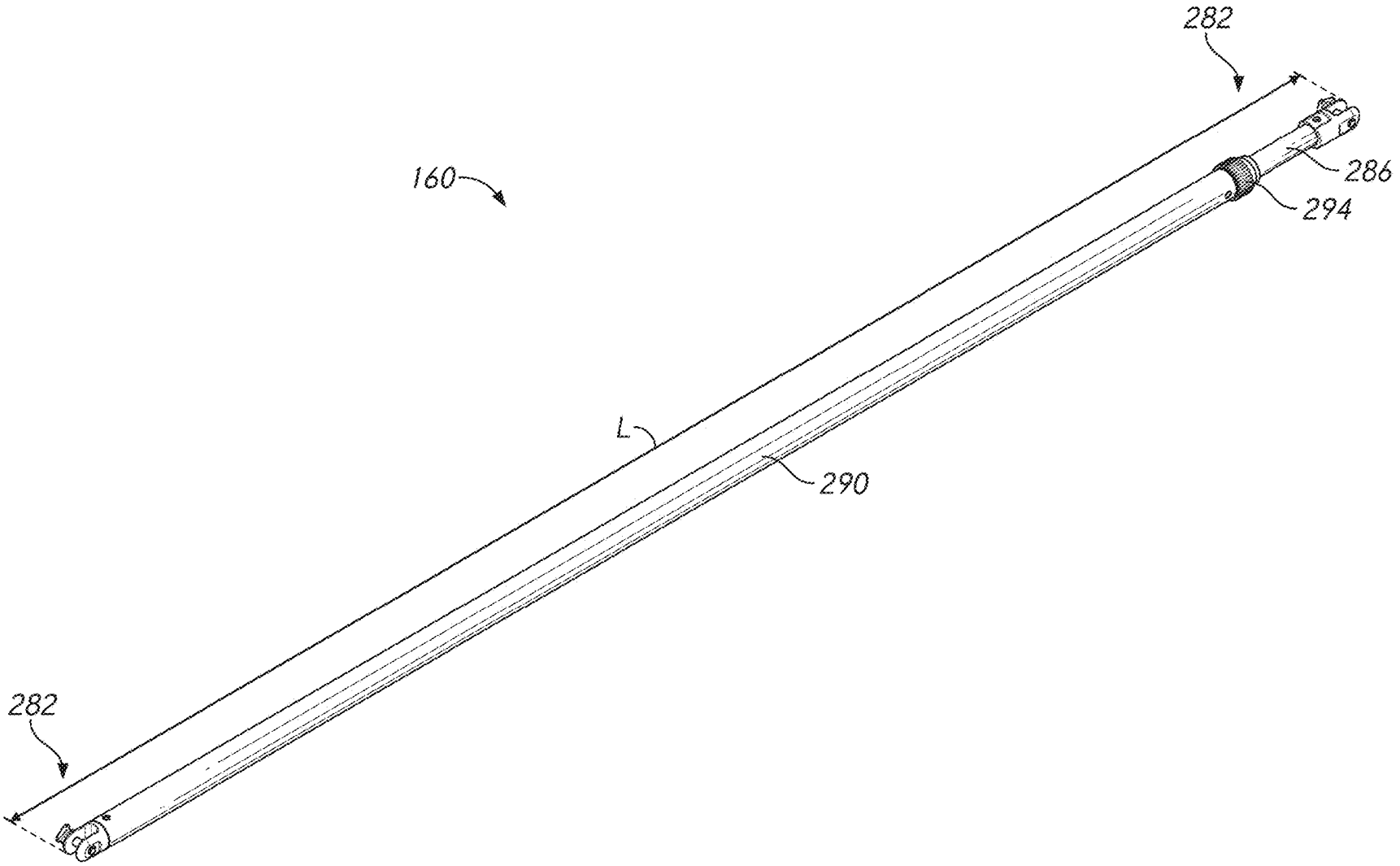
FIG. 10A is a perspective view of a strut of the stabilizing assembly of FIG. 1.
Figure 11:
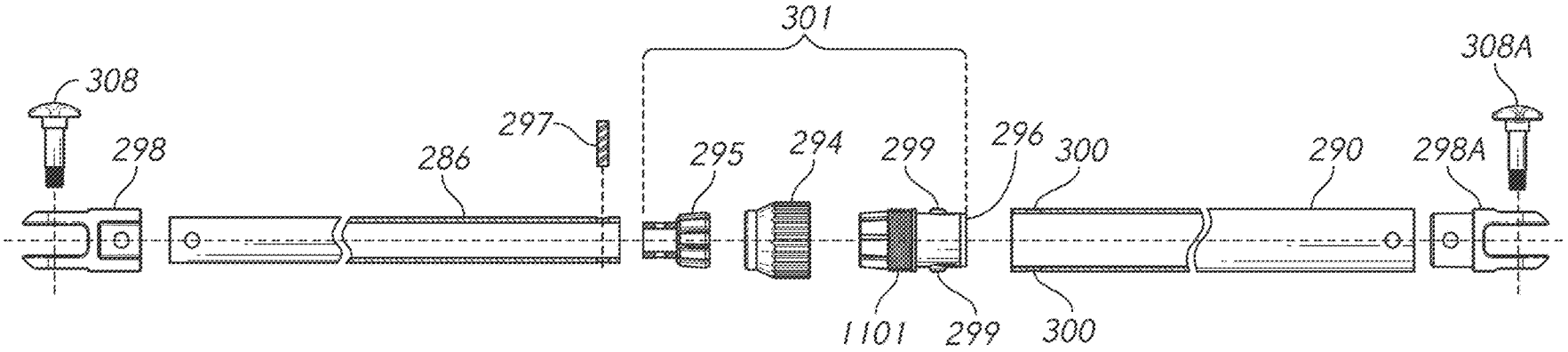
FIG. 11 is an exploded view of the strut of FIG. 10A.

FIG. 10A is a perspective view of an example embodiment of the strut 160. FIG. 11 is an exploded view of the strut 160. With reference to FIG. 10A, the length L of the strut 160 can be fixed or adjustable. The strut 160 can have a first end 278 and a second end 282. The first end 278 of the strut 160 can be pivotably coupled to the base member 176 of the support assembly 156 as disclosed herein. The second end 282 of the strut 160 can be pivotably coupled to a rib 132 and/or the rib fixation assembly 164 disposed around the rib 132 as disclosed herein.

The strut 160 can include a first tubular member 286 coupled to a second tubular member 290. The first tubular member 286 can be coupled to the second tubular member 290 in a telescoping arrangement. At least a portion of the first tubular member 286 can be moveably disposed within the second tubular member 290. The first tubular member 286 can slide within the second tubular member 290. The second tubular member 290 can be moved relative to the first tubular member 286. When the first tubular member is moved in a first direction within the second tubular member 290, an overall length L of the strut 160 can increase. When the first tubular member is moved in a second direction, opposite the first direction, within the second tubular member 290, the overall length L of the strut 160 can decrease.

The strut 160 can include an outer locking member or clamping block 294. The outer locking member 294 can be rotatably coupled to an end of the second tubular member 290 that the first tubular member 286 is positioned within. The outer locking member 294 can be rotated in a first direction to lock or fix the overall length L of the strut 160. The outer locking member 294 can be rotated in a second direction opposite the first direction to unlock the first tubular member 286 and second tubular member 290 such that the overall length L of the adjustable strut 160 can be adjusted.

Turning to FIG. 11, the strut 160 can include a first inner locking member or stabilizing claw 295 and a second inner locking member or clamping block 296. The first inner locking member 295 can be fixed to the end of the first tubular member 286 that is inserted into the second tubular member 290. The first inner locking member 295 can be fixed to the first tubular member 286 using a mechanical fastener such as a pin 297. The first inner locking member 295 and the first tubular member 286 can form a single integral or unitary part. The second inner locking member 296 can be removably coupled to the second tubular member 290. The second inner locking member 296 can have one or more compressible protrusions 299 that extend outward. The one or more compressible protrusions 299 can extend into corresponding holes 300 of the second tubular member 290. The one or more compressible protrusions 299 can be compressed to disengage the holes 300 and allow disconnection of the second tubular member 290 and second inner locking member 296. The second inner locking member 296 can have a thread 1101 on an outside surface of the second inner locking member 296 that is configured to engage a threaded inner surface of the outer locking member 294. The rotation of the outer locking member 294 and the interaction between the thread 1101 of the inner locking member 296 and the threaded inner surface of the outer locking member 294 can increase or decrease the tightness of the locking members.

The second inner locking member 296 can be sized to receive the first inner locking member 295. The first inner locking member 296 being received within the second inner locking member 296 can couple the first tubular member 286 and the second tubular member 290 together. In some embodiments, the first inner locking member 295, the second inner locking member 296, and the outer locking member 294 operate as a collet 301, to selectively lock the first tubular member 286 to the second tubular member 290 by rotation the outer locking member 294.

The length of the strut 160 can be adjusted by rotating the outer locking member 294 in a first direction such that the collet 301 loosens the first tubular member 286 to allow the first tubular member 286 to be moved to the desired positioning which can adjust the length of the strut 160. Once in the desired position, the outer locking member 294 can be rotated in the opposite direction to tighten the collet 301, thus securing the first tubular member 286 in a relatively fixed position.

Figure 10B:
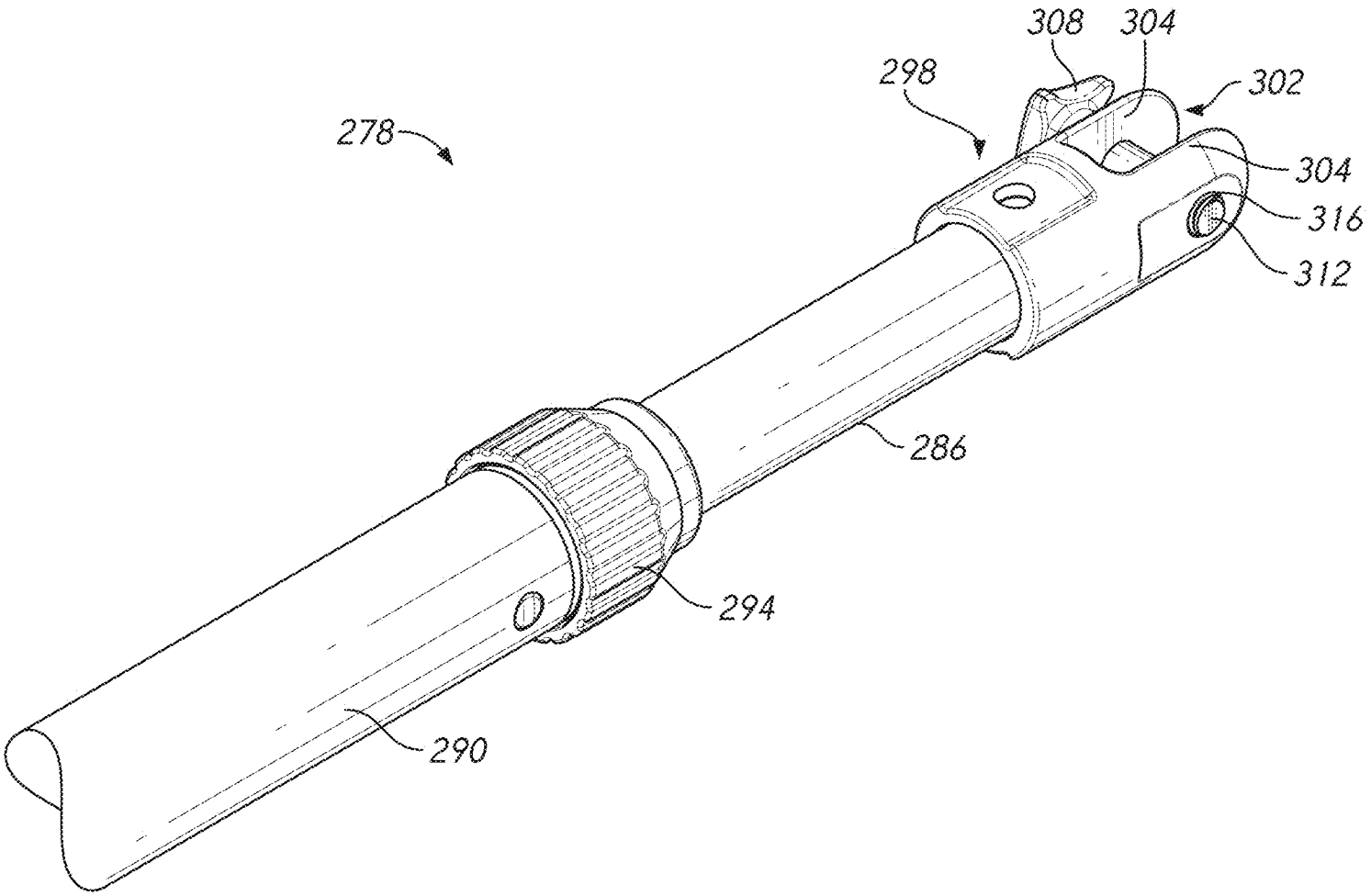
FIG. 10B is a perspective view of a first end of the strut of FIG. 10A.
Figure 10D:
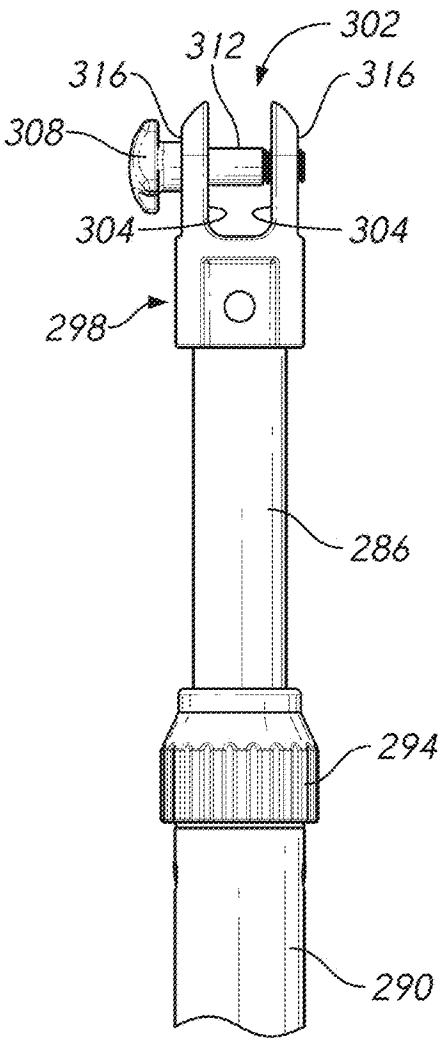
FIG. 10D is a top view of the first end of the strut of FIG. 10A.
Figure 10C:
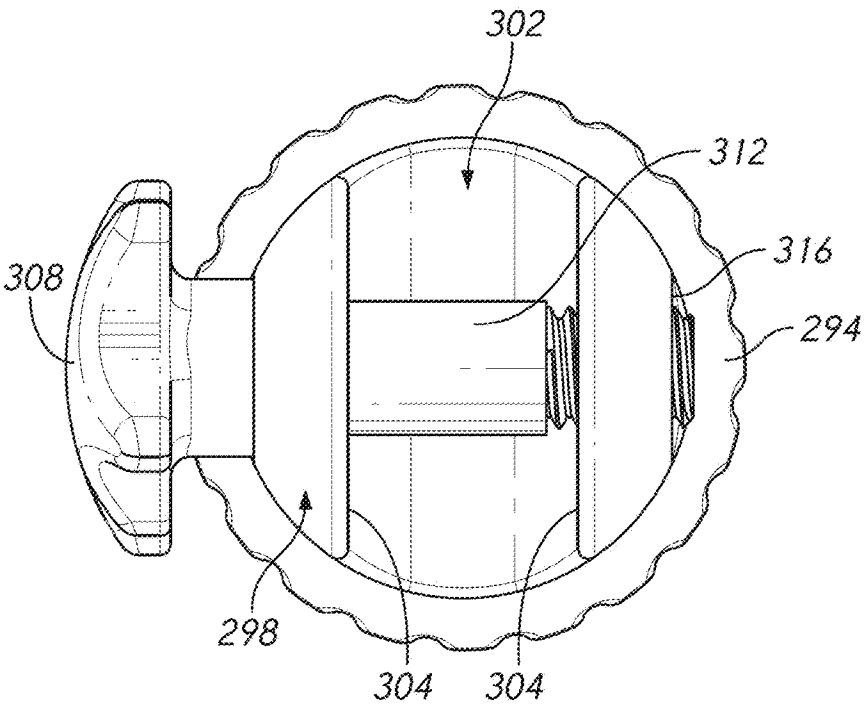
FIG. 10C is a front view of the first end of the strut of FIG. 10A.

FIGS. 10B-D show the first end 278 of the strut 160. The first end 278 of the strut 160 can be coupled to the support assembly 156. A connector or umbrella joint 298 can be coupled to the first end of the strut 160. The connector 298 can be generally U-shaped. The connector 298 can be coupled to the first end 278 of the strut 160 by any suitable means, for example, the connector 298 can be connected to the strut via a latch or compressible pin that extends into an opening of the strut. The connector 298 can be received around an outer diameter of the first end 278 of the strut 160 where the connector 298 has an inner diameter that is sized to snugly fit around the first end 278 and retain the connector 298 in place. The connector 298 and the first end 278 can form a single integral or unitary structure. The connector 298 can be mechanically secured to the first end 278, for example, through the use of a pin or screw. The connector 298 can have a receiving area 302 configured to receive the strut seat 180. The receiving area 302 can have two generally planar walls 304 that correspond to the two generally planar surfaces 220 of the strut seat 180. Each of the two generally planar surfaces 220 can generally align with one of the generally planar walls 304 when the strut seat 180 is positioned within the receiving area 302.

The connector 298 can include a securing knob or positioning pin 308. The securing knob 308 can include a shaft 312. In some embodiments, at least a portion of the shaft 312 can be threaded. The securing knob 308 can be positioned such that the shaft 312 extends through a first and/or a second opening 316 of the connector 298. The opening(s) 316 can extend through the walls 304. When the strut seat 180 is disposed within the receiving area, the shaft 312 of the securing knob 308 can extend through the through hole 224 of the strut seat 180 to secure the strut seat 180 to the strut 160. The securing knob 308 can be rotated in a first direction to move the shaft 312 through one or more of the openings 316 and through hole 224 to secure the strut seat 180 to the strut 160. The securing knob 308 can be rotated in a second direction, opposite the first direction, to remove the shaft 312 from one or more of the openings 316 and through hole 224 to allow the strut seat 180 to be decoupled from the strut 160.

Figure 10F:
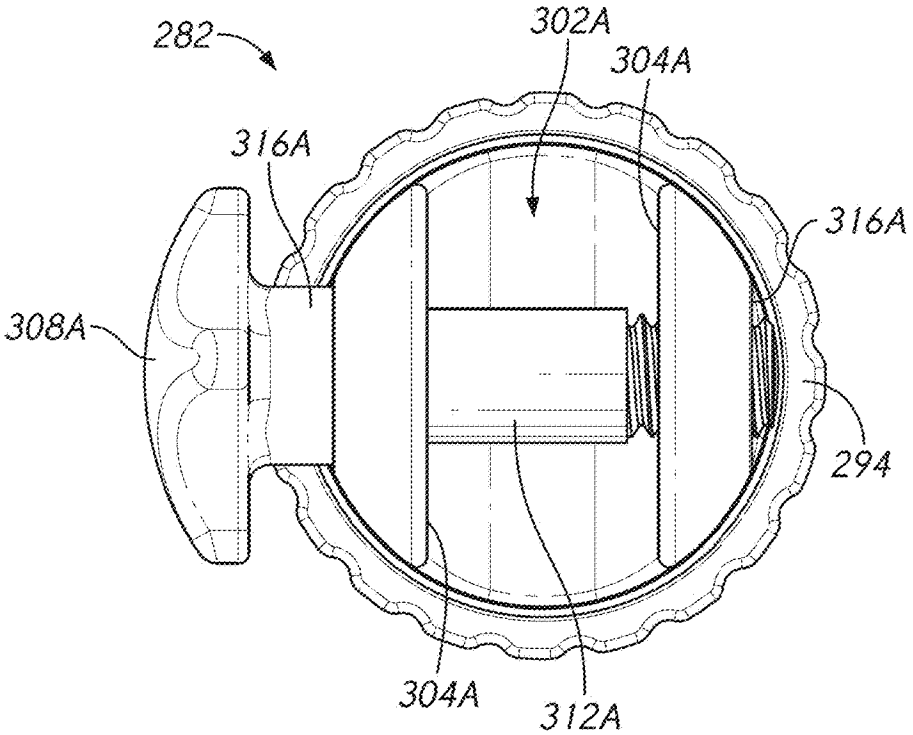
FIG. 10F is a front view of the second end of the strut of FIG. 10A.
Figure 10E:
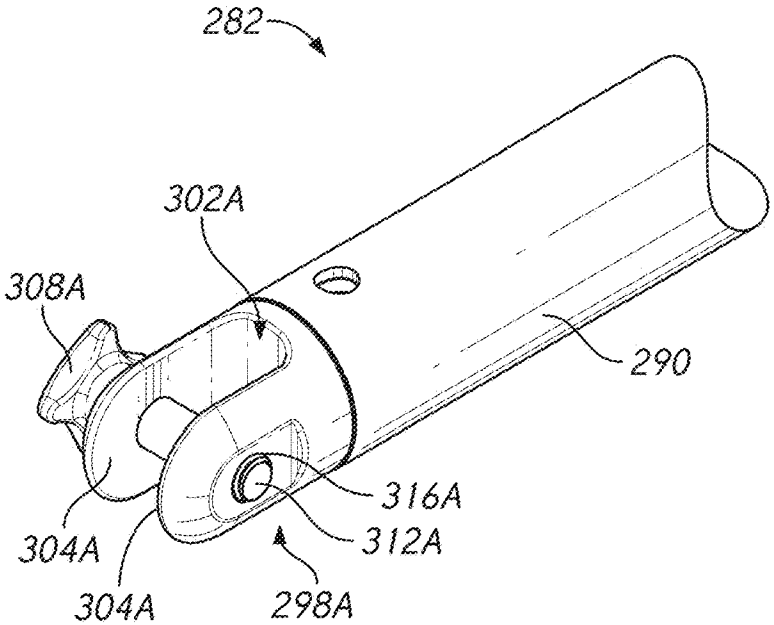
FIG. 10E is a perspective view of a second end of the strut of FIG. 10A.
Figure 10G:
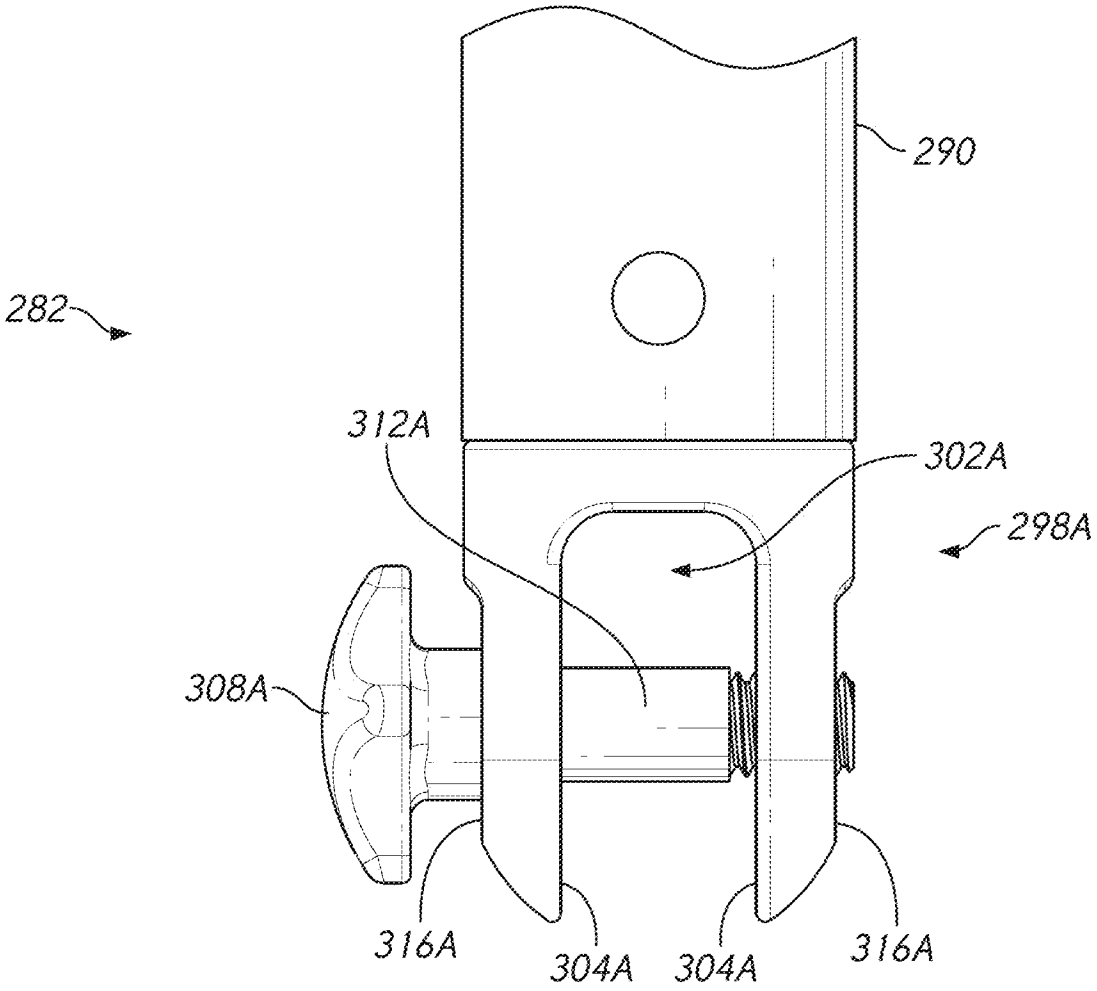
FIG. 10G is a top view of the first end of the strut of FIG. 10A.
Figure 10H:
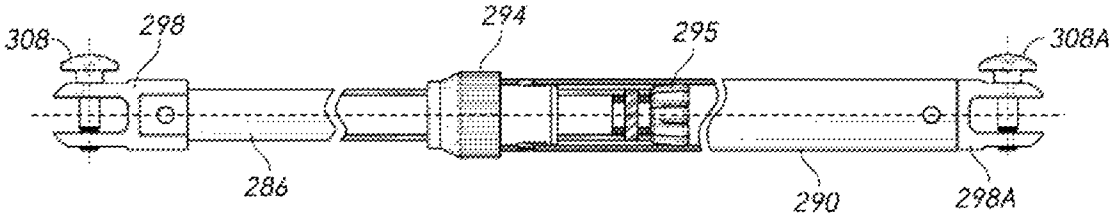
FIG. 10H is a partial cross-sectional view of the strut of FIG. 10A, the strut having a first tubular member coupled with a second tubular member.
Figure 10I:
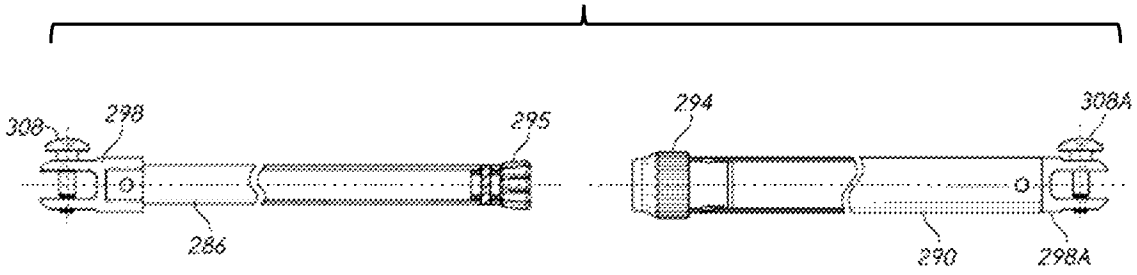
FIG. 10I is a partial cross-sectional view of the strut of FIG. 10A, with the first tubular member decoupled from the second tubular member.

FIGS. 10E-G show the second end 282 of the strut 160. The second end 282 of the strut 160 can be coupled to rib 132 and/or the rib fixation assembly 164. Some of the features of the second end 282 are similar to features of the first end 278 in FIGS. 10B-D. Thus, reference numerals used to designate the various components of the second end 282 are identical to those used for identifying the corresponding components of the first end 278 in FIGS. 10B-D, except that an "A" has been added to the numerical identifier. Therefore, the structure and description for the various features of the first end 278 and how it operates in FIGS. 10B-D are understood to also apply to the corresponding features of the second end 282 in FIGS. 10E-G, except as described below. Though the features below are described in connection with the second end 282, the features also apply to all ends of the strut 160, such as the first end 278 disclosed herein.

The connector or post connector 298A can be coupled to the second end 282 of the strut 160 by any suitable means, for example, the connector 298 can be connected to the strut via a latch or compressible pin that extends into an opening of the strut. The connector 298A can be generally U-shaped. The connector 298A can be received around an outer diameter of the second end 282 of the strut 160 where the connector 298A has an inner diameter that is sized to snugly fit around the second end 282 and retain the connector 298A in place. The connector 298A and the second end 282 can form a single integral or unitary structure. The connector 298A can be mechanically secured to the second end 282, for example, through the use of a pin or screw. The connector 298A can have a receiving area 302A configured to receive the strut seat 180A of the rib fixation assembly 164. The receiving area 302A can have two generally planar walls 304 that correspond to the two generally planar surfaces 220A of the strut seat 180A. Each of the two generally planar surfaces 220A can generally align with one of the generally planar walls 304A when the strut seat 180A is positioned within the receiving area 302A.

The connector 298A can include a securing knob 308A. The securing knob 308A can include a shaft 312A. In some embodiments, at least a portion of the shaft 312A can be threaded. The securing knob 308A can be positioned such that the shaft 312A extends through a first and/or a second opening 316A of the connector 298A. The opening(s) 316 can extend through the walls 304A. When the strut seat 180A is disposed within the receiving area 302A, the shaft 312A of the securing knob 308A can extend through the through hole 224A of the strut seat 180A to secure the strut seat 180A to the strut 160. The securing knob 308A can be rotated in a first direction to move the shaft 312A through one or more of the openings 316A and through hole 224A to secure the strut seat 180A to the strut 160. The securing knob 308A can be rotated in a second direction, opposite the first direction, to remove the shaft 312A from one or more of the openings 316A and through hole 224A to allow the strut seat 180A to be decoupled from the strut 160.

Assembling the Stabilizing Assembly

Following is one example process that can be used to install and adjust a stabilizing assembly as disclosed herein. Although the various procedures included in this process are given in a particular order, the disclosure is not limited to this specific process, and other orders may be used. The stabilizing assembly 116 can be assembled to connect the upright pole 104 to one or more ribs 132 of the umbrella assembly 100. First, a first strut 160 of the stabilizing assembly 116 can be coupled to a rib 132 that is closest to the right or left of the upright pole 104. Next, a second strut 160 of the stabilizing assembly 116 can be coupled to the other of the rib 132 that is closest to the right or left of the upright pole 104. Coupling the strut(s) 160 to ribs 132 that are closest to the upright pole 104 can allow for shorter strut(s) to be used while also eliminating or reducing interference from other ribs 132 of the umbrella assembly 100. Each strut 160 can be coupled to a rib 132 via the rib fixation assembly 164, according to an embodiment of the present disclosure. The rib fixation assembly 164 can be positioned at or near a generally central location along the length of the rib 132.

Next, the support assembly 156 can be slidably coupled to the upright pole 104, according to embodiments of the present disclosure. The pawl 184 of the support assembly 156 can be rotated such that the pawl 184 can be inserted through the channel 168 and into the internal cavity 172 of the upright pole 104. The pawl 184 can be positioned such that the blocking portions 238 engages the pin 249 to limit the movement of the pawl 184 to the rack. The clamping block 196 can also be rotated such that the clamping block 196 can be inserted through the channel 168 and into the internal cavity 172. Once the pawl 184 and the clamping block 196 are positioned such that they can be inserted into the internal cavity 172 of the upright pole 104, the support assembly 156 can be moveably slid within the internal cavity 172 to the desired positioning along the height of the upright pole 104. The positioning knob 192 of the pawl 184 can be rotated to disengage the pin 249 and the blocking portions 238 allowing the teeth 188 of the pawl 184 to engage the rack 228 and limit movement of the support assembly 156. To allow relatively easy repositioning of the support assembly 156, the positioning knob 192 can be pulled outward (disengaging the pawl 184 from the rack 228) and released inward (engaging the pawl 184 with the rack 228) one or more times while adjusting the height of the support assembly 156.

Once in the desired position the clamping knob 200 can be rotated to position the clamping block 196 with the surfaces 198 of the clamping block 196 engaged with the inner surfaces 197 of the upright pole 104. The engagement of the inner surfaces 197 and the surfaces 198 of the clamping block 196 can lock the support assembly 156 in place while completing the assembly.

Next, the umbrella assembly 100 can be transitioned to an at least partially opened positioned. The first end 278 of each strut 160 can be coupled to one of the strut seats 180 of the support assembly 156, according to embodiments of the present disclosure. The length of the struts 160 can then be adjusted as needed, according to embodiments of the present disclosure.

The umbrella assembly 100 can then be transitioned to an open configuration. The positioning of the support assembly 156 along the height of the upright pole 104 can be adjusted again, if needed (such as by releasing the clamping block 196, pulling on and releasing the positioning knob 192 as needed, and finally re-engaging the clamping block 196 to re-lock the support assembly 156 in place).

The outer locking member 294 of each strut 160 can then be rotated to tighten or secure the positioning and/or length of the strut 160. The tightening of the outer locking member 294 can fix the length of the strut 160.

Once the assembly of the stabilizing assembly 116 is complete, the stabilizing assembly 116 can be tested by attempting to shake or move the umbrella assembly 100. If the stabilizing assembly 116 needs to be adjusted in view of the testing, one or more of the support assembly 156, struts 160, and/or rib fixation assemblies 164 can be adjusted.

The adjustability and/or removability of the stabilizing assembly 116 can be advantageous in that the system can be added or removed to an umbrella assembly (e.g., umbrella assembly 100) without needing to alter the umbrella assembly. Additionally, the removability of the stabilizing assembly 116 can allow the umbrella assembly to be opened and/or closed without interference. The stabilizing assembly 116 can also increase the wind resistance of the umbrella assembly and the assembly of the stabilizing assembly 116 can be easy and efficient.

Additional Information

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. An umbrella assembly comprising:

an upright pole that extends along a longitudinal direction;

a canopy assembly comprising a hub and a plurality of ribs extending from the hub, the plurality of ribs configured to support a cover in a deployed configuration;

a frame assembly that connects the canopy assembly to the upright pole in a cantilever manner, the frame assembly comprising:

a cantilever beam, the cantilever beam coupled at a first end to the upright pole, and at a second end to the hub of the canopy assembly; and an adjustable stabilizing assembly for stabilizing the canopy assembly with respect to the upright pole, the adjustable stabilizing assembly comprising:

a support assembly slidably coupled to the upright pole such that the support assembly can be fixed with respect to the upright pole at a plurality of positions along the longitudinal direction, the support assembly comprising a base member and a first strut seat coupled to or formed as part of the base member; and a first adjustable length strut having a first end and a second end, wherein the first end of the first adjustable length strut is pivotally coupled to the base member of the support assembly by the first strut seat, and wherein the second end of the first adjustable length strut is pivotally coupled to a first rib of the plurality of ribs of the canopy assembly.

2. The umbrella assembly of claim 1, wherein the support assembly further comprises a second strut seat coupled to or formed as part of the base member, and wherein the adjustable stabilizing assembly further comprises:

a second adjustable length strut having a first end and a second end, wherein the first end of the second adjustable length strut is pivotally coupled to the base member of the support assembly by the second strut seat, and wherein the second end of the second adjustable length strut is pivotally coupled to a second rib of the plurality of ribs of the canopy assembly.

3. The umbrella assembly of claim 1, wherein the adjustable stabilizing assembly further comprises a first rib fixation assembly that is slidably coupled to the first rib and can be fixed with respect to the first rib at a plurality of positions along a length of the first rib, and wherein the second end of the first adjustable length strut is pivotally coupled to the first rib by the first rib fixation assembly.

4. The umbrella assembly of claim 3, wherein the support assembly is removable from the upright pole, and the first rib fixation assembly is removable from the first rib.

5. The umbrella assembly of claim 4, wherein the first rib fixation assembly is removable from the first rib by pivoting a first member of the first rib fixation assembly away from a second member of the first rib fixation assembly.

6. The umbrella assembly of claim 5, wherein a clamp mechanism is configured to selectively maintain the first member and the second member in a closed configuration.

7. The umbrella assembly of claim 1, wherein the upright pole comprises a channel extending along the longitudinal direction, with at least a portion of the support assembly extending through the channel into an internal cavity of the upright pole, the upright pole further comprising a rack positioned within the internal cavity and extending along the longitudinal direction, the support assembly further comprising:

a spring-loaded pawl comprising one or more teeth shaped to engage the rack of the upright pole, the spring-loaded pawl being biased toward engagement of the one or more teeth with the rack; and a positioning knob operable to overcome the biasing of the spring-loaded pawl to selectively disengage the one or more teeth from the rack, wherein the spring-loaded pawl is configured to limit movement of the support assembly with respect to the upright pole with the one or more teeth engaged with the rack, and wherein the spring-loaded pawl is configured to not limit movement of the support assembly with respect to the upright pole with the one or more teeth not engaged with the rack.

8. The umbrella assembly of claim 7, wherein the positioning knob is coupled to a shaft of the spring-loaded pawl, such that pulling the positioning knob in a direction away from the rack will cause the one or more teeth to be pulled in the direction away from the rack.

9. The umbrella assembly of claim 8, wherein the shaft of the spring-loaded pawl comprises a pin extending laterally from the shaft, wherein the base member of the support assembly comprises an opening that allows the pin to pass therethrough with the positioning knob and shaft in a first rotational orientation, and wherein the base member of the support assembly comprises a blocking portion that engages the pin to limit movement of the one or more teeth toward the rack with the positioning knob and shaft in a second rotational orientation.

10. The umbrella assembly of claim 7, wherein the frame assembly further comprises a pinion gear that engages the rack, wherein the pinion gear is configured such that rotation of the pinion gear with respect to the rack will adjust a position of the first end of the cantilever beam with respect to the upright pole along the longitudinal direction.

11. The umbrella assembly of claim 7, wherein the support assembly further comprises:

a clamping block positioned within the internal cavity of the upright pole; and a clamping knob operable to selectively force the clamping block against a surface of the internal cavity of the upright pole to selectively maintain the support assembly in a fixed position with respect to the upright pole.

12. The umbrella assembly of claim 11, wherein the support assembly further comprises a threaded shaft coupled to the clamping knob and the clamping block, such that rotation of the clamping knob with respect to the clamping block will cause the clamping knob and clamping block to be forced toward or away from one another.

13. The umbrella assembly of claim 1, wherein the first adjustable length strut comprises:

a first tubular member slideably coupled to a second tubular member in a telescoping arrangement; and a collet that selectively permits or restricts telescoping of the first tubular member with respect to the second tubular member.

14. The umbrella assembly of claim 1, wherein the support assembly is coupled to the upright pole at a position below where the first end of the cantilever beam is coupled to the upright pole.

15. An umbrella assembly comprising:

an upright pole that extends along a longitudinal direction;

a canopy assembly comprising a hub and a plurality of ribs extending from the hub, the plurality of ribs configured to support a cover in a deployed configuration;

a frame assembly that connects the canopy assembly to the upright pole in a cantilever manner, the frame assembly comprising:

a cantilever beam, the cantilever beam coupled at a first end to the upright pole, and at a second end to the hub of the canopy assembly; and a removable stabilizing assembly for stabilizing the canopy assembly with respect to the upright pole, the removable stabilizing assembly comprising:

a support assembly removably coupled to the upright pole, the support assembly comprising a base member and a first strut seat coupled to or formed as part of the base member;

a first rib fixation assembly removably coupled to a first rib of the plurality of ribs of the canopy assembly; and a first strut having a first end and a second end, wherein the first end of the first strut is pivotally coupled to the base member of the support assembly by the first strut seat, and wherein the second end of the first strut is pivotally coupled to the first rib fixation assembly.

16. The umbrella assembly of claim 15, wherein the support assembly further comprises a second strut seat coupled to or formed as part of the base member, and wherein the removable stabilizing assembly further comprises:

a second rib fixation assembly removably coupled to a second rib of the plurality of ribs of the canopy assembly; and a second strut having a first end and a second end, wherein the first end of the second strut is pivotally coupled to the base member of the support assembly by the second strut seat, and wherein the second end of the second strut is pivotally coupled to the second rib fixation assembly.

17. The umbrella assembly of claim 15, wherein the upright pole comprises a channel extending along the longitudinal direction, with at least a portion of the support assembly extending through the channel into an internal cavity of the upright pole, wherein the support assembly further comprises a clamping block positioned within the internal cavity of the upright pole, the clamping block comprising at least a first orientation with respect to the base member and a second orientation with respect to the base member, wherein, in the first orientation, the clamping block is configured to clamp a wall of the upright pole between the clamping block and the base member, and wherein, in the second orientation, the clamping block is configured to be passable through the channel to enable removal of the support assembly from the upright pole.

18. The umbrella assembly of claim 15, wherein the first rib fixation assembly comprises:

a first member shaped to at least partially wrap around the first rib;

a second member pivotally coupled to the first member, the second member pivotable with respect to the first member between an open configuration and a closed configuration, wherein, in the open configuration, the first rib fixation assembly can be coupled to or removed from the first rib, and, in the closed configuration, the first rib fixation assembly is fixed to the first rib; and a clamp mechanism configured to selectively maintain the second member in the closed configuration.

19. The umbrella assembly of claim 18, wherein the clamp mechanism comprises a quick release buckle.

20. The umbrella assembly of claim 15, wherein the support assembly is coupled to the upright pole at a position below where the first end of the cantilever beam is coupled to the upright pole.

21. The umbrella assembly of claim 15, wherein the support assembly is slidably coupled to the upright pole such that the support assembly can be fixed with respect to the upright pole at a plurality of positions along the longitudinal direction, wherein the first strut is an adjustable length strut, and wherein first rib fixation assembly is slidably coupled to the first rib such that the first rib fixation assembly can be fixed with respect to the first rib at a plurality of positions along a length of the first rib.

22. The umbrella assembly of claim 15, wherein the removable stabilizing assembly is removable without disassembling the frame assembly or the canopy assembly.

23. The umbrella assembly of claim 15, wherein the support assembly is removable from the upright pole in a direction transverse to a longitudinal axis of the upright pole.

24. The umbrella assembly of claim 15, wherein the first rib fixation assembly is removable from the first rib in a direction transverse to a longitudinal axis of the first rib.

25. A removable stabilizing assembly for stabilizing a canopy assembly of a cantilever umbrella assembly, the removable stabilizing assembly comprising:

a support assembly removably coupleable to an upright pole of a cantilever umbrella assembly, the support assembly comprising a base member and a first strut seat coupled to or formed as part of the base member;

a first rib fixation assembly removably coupleable to a first rib of a plurality of ribs of a canopy assembly of the cantilever umbrella assembly; and a first strut having a first end and a second end, wherein the first end of the first strut is pivotally coupled to the base member of the support assembly by the first strut seat, and wherein the second end of the first strut is pivotally coupled to the first rib fixation assembly.

26. The removable stabilizing assembly of claim 25, wherein the support assembly further comprises a clamping block comprising at least a first orientation with respect to the base member and a second orientation with respect to the base member, wherein, in the first orientation, the clamping block is configured to clamp a wall of an upright pole between the clamping block and the base member, and wherein, in the second orientation, the clamping block is configured to be passable through a channel of the upright pole to enable removal of the support assembly from the upright pole.

27. The removable stabilizing assembly of claim 25, wherein the first rib fixation assembly comprises:

a first member shaped to at least partially wrap around the first rib;

a second member pivotally coupled to the first member, the second member pivotable with respect to the first member between an open configuration and a closed configuration, wherein, in the open configuration, the first rib fixation assembly can be coupled to or removed from the first rib, and, in the closed configuration, the first rib fixation assembly is configured to be fixed to the first rib; and a clamp mechanism configured to selectively maintain the second member in the closed configuration.

* * * * *